US008690470B2

(12) United States Patent
Cash et al.

(10) Patent No.: US 8,690,470 B2
(45) Date of Patent: Apr. 8, 2014

(54) ADJUSTABLE CONNECTOR FOR TUBULAR FRAMES

(76) Inventors: Wayne L. Cash, Goddard, KS (US); Larry J. Hooker, Olathe, KS (US)

( * ) Notice: Subject to any disclaimer, the term of this patent is extended or adjusted under 35 U.S.C. 154(b) by 1094 days.

(21) Appl. No.: 12/684,583

(22) Filed: Jan. 8, 2010

(65) Prior Publication Data

US 2010/0172690 A1 Jul. 8, 2010

Related U.S. Application Data

(60) Provisional application No. 61/143,183, filed on Jan. 8, 2009.

(51) Int. Cl.
*A45B 17/00* (2006.01)

(52) U.S. Cl.
USPC ..... 403/93; 403/103; 403/379.6; 297/184.16; 135/16

(58) Field of Classification Search
USPC ..... 403/92, 93, 99, 103, 109.7, 109.8, 328, 403/326, 379.1, 379.6, 378; 248/514, 541; 297/184.15, 184.16; 135/16, 98
See application file for complete search history.

(56) References Cited

U.S. PATENT DOCUMENTS 3,304,035 A * 2/1967 Davis ..... 248/516
3,304,036 A * 2/1967 Davis ..... 248/514
3,602,466 A * 8/1971 Drowns ..... 248/514
5,431,364 A * 7/1995 Etter ..... 248/514
5,518,218 A * 5/1996 Leonard ..... 248/530
5,624,199 A * 4/1997 Cheng ..... 403/100
5,727,583 A * 3/1998 Kennedy ..... 135/20.1
6,364,562 B1 * 4/2002 Tung ..... 403/93
6,435,469 B1 * 8/2002 Ratcliff et al. ..... 248/535
6,471,289 B2 * 10/2002 Aguilar ..... 297/184.16
6,533,237 B1 * 3/2003 Matusek ..... 248/514
7,201,442 B1 4/2007 Decosta
7,296,377 B2 * 11/2007 Wilcox et al. ..... 43/21.2
8,091,962 B2 * 1/2012 Quinn ..... 297/184.16
2004/0222678 A1 * 11/2004 Hansen ..... 297/184.1

* cited by examiner

*Primary Examiner* — Joshua Kennedy
(74) *Attorney, Agent, or Firm* — Law Office of Mark Brown, LLC; Mark E. Brown; Christopher M. DeBacker

(57) ABSTRACT

An adjustable connector for elongated members is provided having a mount attached to a first elongated member, such as a chair support, and a tubular arm assembly pivotally connected to the mount and attached to a second elongated member, such as an umbrella or flag. The arm assembly is selectively positioned in relation to the mount by adjusting pegs that extend from the arm assembly and engage receivers in the mount. A tubular cam within the arm assembly is connected to a tubular sleeve on the exterior of the arm assembly. The sleeve is slid toward the mount causing the cam to disengage the pegs from the mount receivers permitting repositioning of the arm assembly from a position adjacent to the mount, through perpendicular to a position parallel to the mount. The connector may be collapsed and remain connected to the elongated members when not in use.

20 Claims, 28 Drawing Sheets

ADJUSTABLE CONNECTOR FOR TUBULAR FRAMES

CROSS-REFERENCE TO RELATED APPLICATIONS

This application claims priority in U.S. Provisional Patent Application No. 61/143,183, filed Jan. 8, 2009, which is incorporated herein by reference.

BACKGROUND OF THE INVENTION

1. Field of the Invention

The present invention relates generally to connectors, and in particular to a connector for supporting an umbrella attachable to a collapsible chair.

2. Description of the Related Art

Collapsible chairs are often used in indoor and outdoor situations where permanent seating is not available. The chairs are manufactured using a variety of materials such as wood, metal, or plastic. The chairs are appealing to the user because they are lightweight, portable, and are available in a variety of colors, sizes, and shapes. Because the structural support members remain interconnected when the chair is in use or in a collapsed position, the chair can be quickly and easily stored when not in use. Chairs manufactured using a tubular metal frame, and fabric supporting surfaces are particularly popular because their low cost of manufacture, and the ability to print text or images on the supporting surfaces, make them widely available.

When a collapsible chair is used outdoors, occupants often want protection from the heat, sun, and precipitation. A properly positioned umbrella can provide such protection. Different sizes and styles of umbrellas are often used with mixed results. Large umbrellas are unwieldy to transport and properly position, and require secure fixation to the ground or another object. Smaller umbrellas can be either held by the occupant or attached to the chair. Various methods of attaching umbrellas to collapsible chairs have been attempted. Most require substantial modification to the structure of the chair to accommodate the umbrella such as securing brackets or mounting hardware to the chair frame, or compromising the integrity of the fabric supporting surfaces. Such modifications affect the stability and safety of the chair, and add weight and bulk to the chair making it difficult to collapse and store. Therefore, there is a need for a connector attachable to a collapsible chair that is lightweight, easy to deploy and does not inhibit the easy transportation and storage of the chair.

Heretofore there has not been available a connector for a tubular chair with the advantages and features of the present invention.

BRIEF SUMMARY OF THE INVENTION

The present invention provides a connector which can be attached to a tubular member of a collapsible chair for mounting an umbrella, flag, or other suitable object. In an embodiment of the present invention, the connector consists of separate mounting and receiving tubes connected by a neck. The connector may be manufactured from plastic, metal, or polymer. The mounting tube is sealed at the top and open at the bottom for receiving a tubular vertical support of a folding chair. The receiving tube is substantially parallel to the mounting tube and spaced a sufficient distance apart to permit reinstallment of the fabric of the chair over the top of the mounting tube. The receiving tube is open at the top for accepting a tubular member such as a ratchet hinge or a post.

The two tubes are connected by a neck that angles down and away from the bottom of the mounting tube to the bottom of the receiving tube, and is welded to the bottom of the receiving tube sealing the end.

The connector is shown installed on a collapsible chair by removing the fabric back of the chair from its tubular vertical supports. The mounting tube is slid over the top of the vertical support and aligned to permit reattachment of a screw securing the back to the vertical support. The back is reinstalled on the vertical support by sliding the end pocket over the mounting tube that is around the vertical support. The back is then resecured to the vertical support by a screw, and the connector can be rotated about the vertical support to properly position the connector and the attached flag or umbrella.

In an alternative embodiment, the connector has a mounting pin connected to a receiving tube by a neck. The neck is of a substantially S-shape sealing the bottom of the receiving tube, extending vertically and away from the receiving tube, and attaching to the top of a mounting pin. The mounting pin is dimensioned to be received within a vertical support of a chair as mentioned above. The mounting pin and receiving tube are parallel and spaced sufficiently apart to permit reinstallation of the fabric back of a chair as mentioned above.

In another alternative embodiment, the connector consists of a metal mounting tube welded to a bracket. The mounting tube and bracket are secured to the bottom of a metal frame by a screw. The frame has an elongated body that extends up from the bracket, substantially parallel to the mounting tube, terminating in a circular clevis-shaped head. The head pivotally receives a tubular arm assembly that rotates about a bolt. The arm assembly has a V-shaped locking spring within a tubular arm that has opposite pegs that engage corresponding register receivers located at the perimeter of the frame head. A tubular sleeve around the exterior of the arm is connected to a forked cam located distal to the spring within the tubular arm. A cam pin connects the sleeve and cam and permits the assembly to slide toward and engage the locking spring. Engaging the spring causes the pegs to disengage from the head permitting repositioning of the arm assembly. An internally located return spring holds the cam and sleeve under tension and returns the cam and sleeve to a position whereby the cam is not engaging the locking spring. An adapter connected to a flag or umbrella can be connected to the distal end of the tubular arm.

In another alternative embodiment, the connector consists of a plastic mounting bracket assembly that pivotally receives a plastic tubular arm assembly that rotates about a bolt. The mounting bracket assembly consists of an integrated mounting tube and frame. The arm assembly has an integrated plastic tubular arm and hub, with an internal metal locking spring, plastic cam and return spring, and an external plastic sleeve. The plastic embodiment connector operates in the same manner as the metallic embodiment connector described above and may also accept an adapter for attaching a flag or an umbrella.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENT

I. Introduction and Environment

Figure 1:
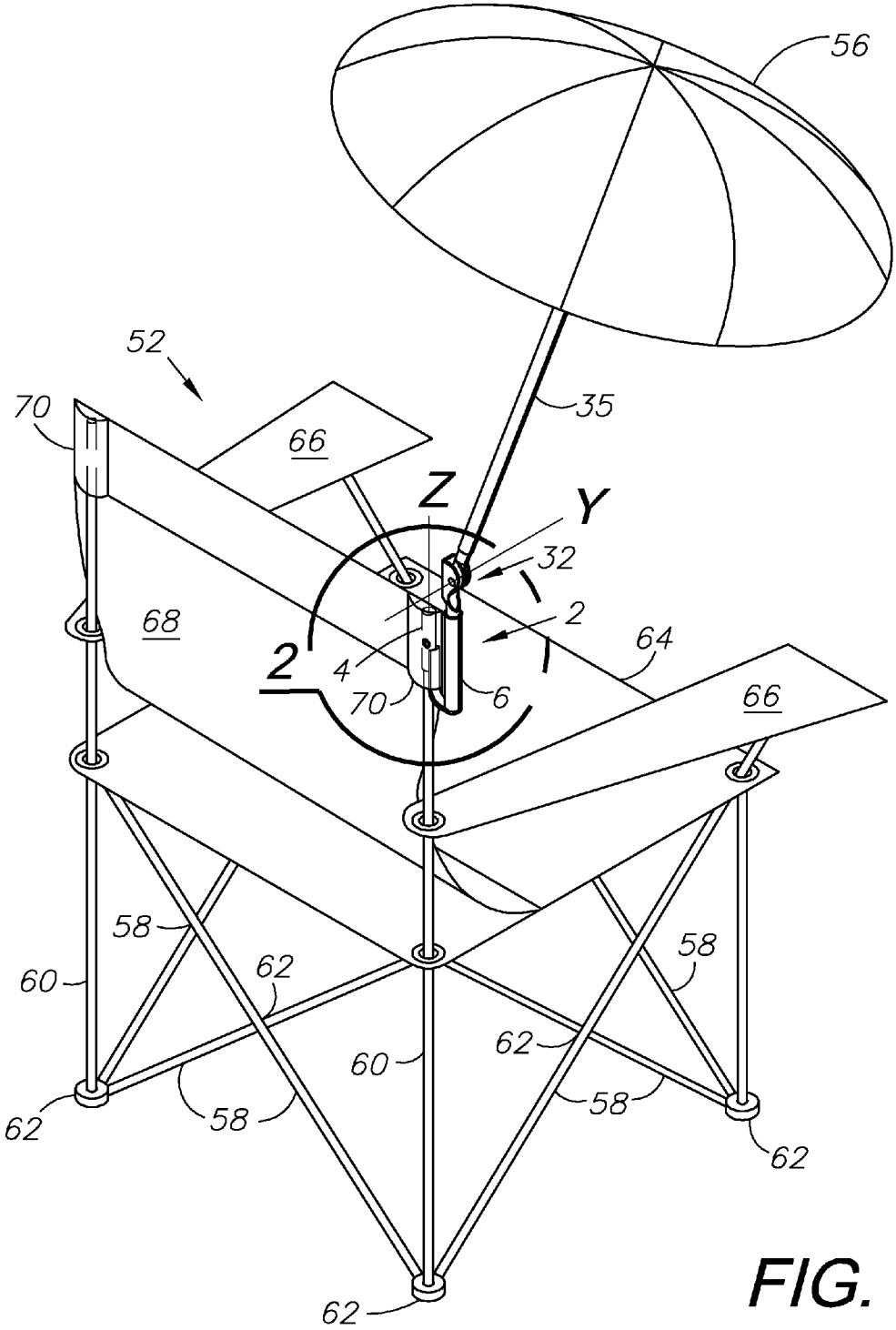
FIG. 1 is a right rear isometric view of the connector embodying the principles of the present invention installed on a chair and attached to an umbrella using a ratcheted hinge.

As required, detailed aspects of the present invention are disclosed herein; however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Connector 2

Referring to the drawings, in FIGS. 1-5 the reference numeral 2 generally designates an embodiment of the adjustable connector for tubular frames of the present invention. Without limitation on the generality of useful constructions or uses, the connector 2 is shown attached to a chair 52 deployed in a usable position, supporting an umbrella 56. The chair 52 can be any type of collapsible chair used in indoor or outdoor environments. The illustrated chair 52 is of the "tailgate chair" type generally constructed with a collapsible tubular steel frame and fabric supporting surfaces. The cross-pieces 58 and vertical supports 60 are made of elongated tubular steel intersecting at joints 62 providing a pivotal connection between intersecting members to allow the chair 52 to be collapsed in upon itself like an accordion into a generally cylindrical shape for transportation or storage in a carrying bag (not shown). The chair 52 has a fabric seat 64, arm rests 66 and back 68. The back 68 has two pockets 70 at the left and right ends of the back 68. The pockets 70 are closed at the top and open at the bottom. The back 68 is attached to the chair by inserting the upper end of each vertical support 60 into the open end of the pocket 70. Once assembled, the chair 52 need not be disassembled in order to collapse the chair for storage and transportation.

The connector 2 includes generally a mount such as a tube 4, receiver such as a tube 6, and a neck 8. The mounting and receiving tubes 4, 6 are parallel elongated tubular structures manufactured from a variety of suitable materials such as metal, plastic or polymer, preferably galvanized steel. The tubes 4, 6 are connected by a neck 8 manufactured from a complementary material, preferably galvanized steel.

In the exemplary embodiment, the connector 2 has a mounting tube 4 that is shorter than the receiving tube 6 whereby the receiving tube 6 extends slightly above the top of the mounting tube 4 and substantially below the bottom of the mounting tube 4. A cap 10 rests on the top of the vertical support 60 and is securely fixed to the top of the mounting tube 4 using suitable means such as welding. At a distance of approximately 1.5" from the top of the tube 4 is located a slot 12. The slot 12 is approximately 40 percent of the tube 4 circumference and is centered on the right side of the tube 4. The slot 12 generally aligns with a receiver (not shown) in the vertical support 60 that receives a screw 74 for attaching the back 68 to the chair 52. The slot 12 permits rotation of the connector 2 about the z-axis while retaining secure attachment of the back 68 to the vertical support 60.

The receiving tube 6 is open at the top end, and sealed at the bottom end by a portion of the neck 8. The neck 8 is welded to the bottom of the receiving tube 6 and extends vertically up and slightly away from the receiving tube 6 where it is welded to the bottom of the mounting tube 4. The mounting tube 4 and receiving tube 6 are spaced a sufficient distance apart, and the distance between the top of the mounting tube 4 and the bottom of the receiving tube 6 are sufficient, to permit reinstallation of the back 68 of a chair 52 as described below.

The connector 2 is employed by first, removing the back 68 of a chair 52 from its vertical support 60. The vertical support 60 is slidably inserted within the mounting tube 4 aligning the slot 12 with the receiver for the screw 74. The back 68 is re-installed on the chair 52 by sliding the pocket 70 over the top of the mounting tube 4 and securing the back 68 to the vertical support 60 by attaching the screw 74. The cap 10 prevents the connector 2 from sliding down the vertical support 60 and permits a bearing surface for rotation of the connector 2 about the top of the vertical support 60 The connector 2 can remain attached to the chair 52 when it is collapsed for storage or transportation because it does not interfere with the mechanics of collapsing the chair 52, and it is not so obtrusive as to prevent proper storage and transportation of the attached chair 52. Alternatively, the connector 2 can be removed from the chair between uses or for redeployment for use with another chair 52. One or more connectors 2 can be used with the chair 52 in the exemplary embodiment by installing the connector 2 on each of the two vertical supports 60.

Figure 2:
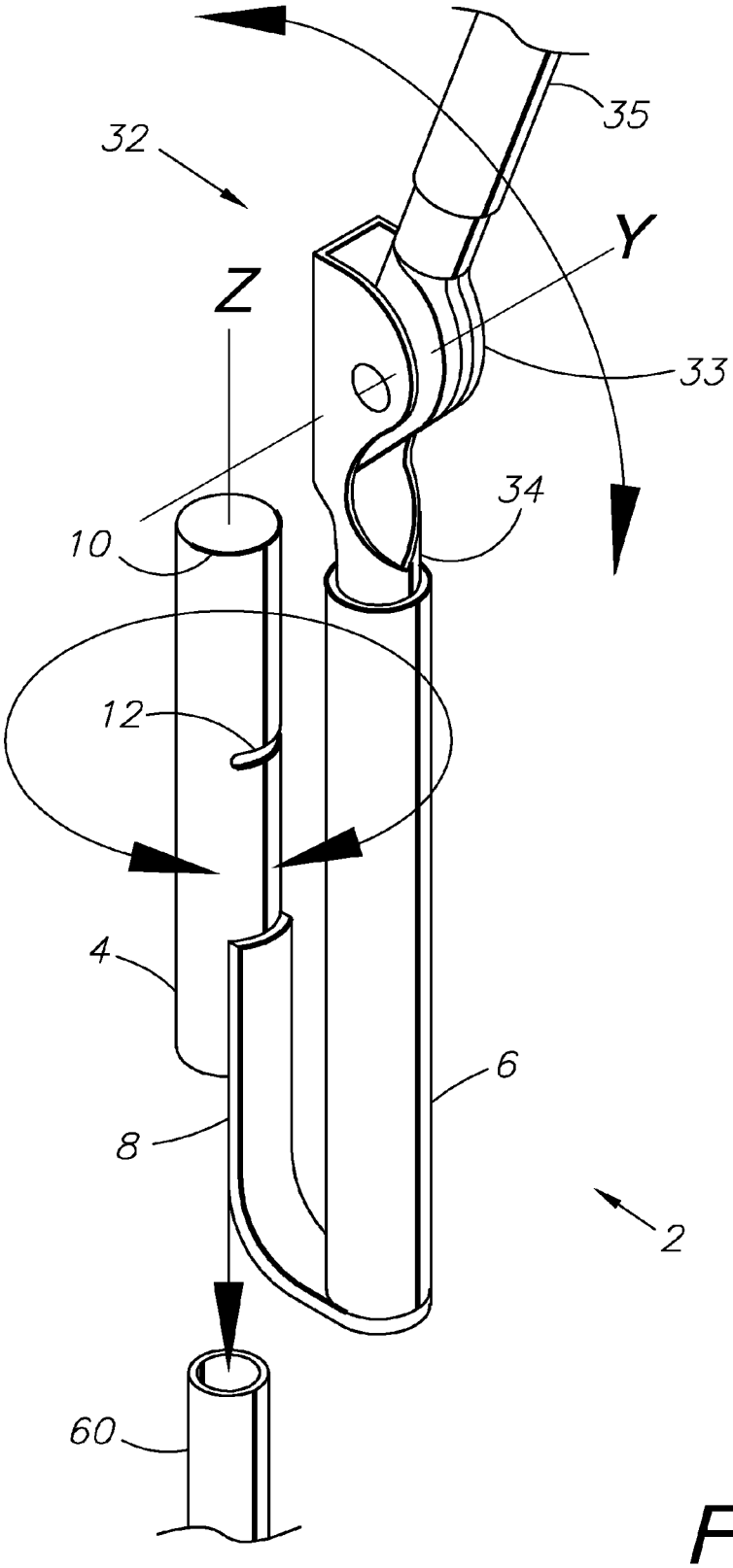
FIG. 2 is an enlarged right rear isometric view of the connector and hinge taken generally within circle 2 in FIG. 1.
Figure 3:
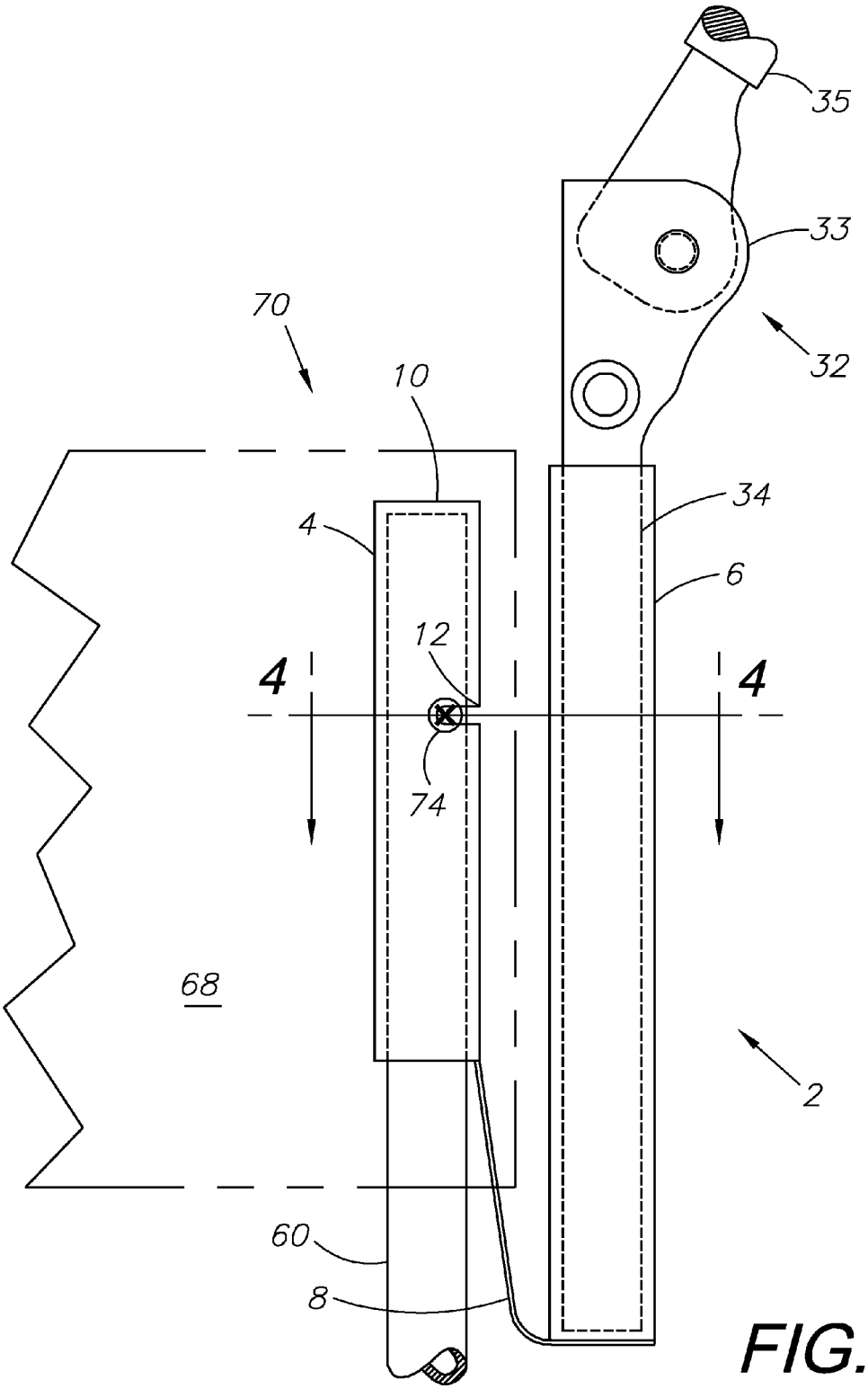
FIG. 3 is a rear elevation view of the connector and hinge.
Figure 4:
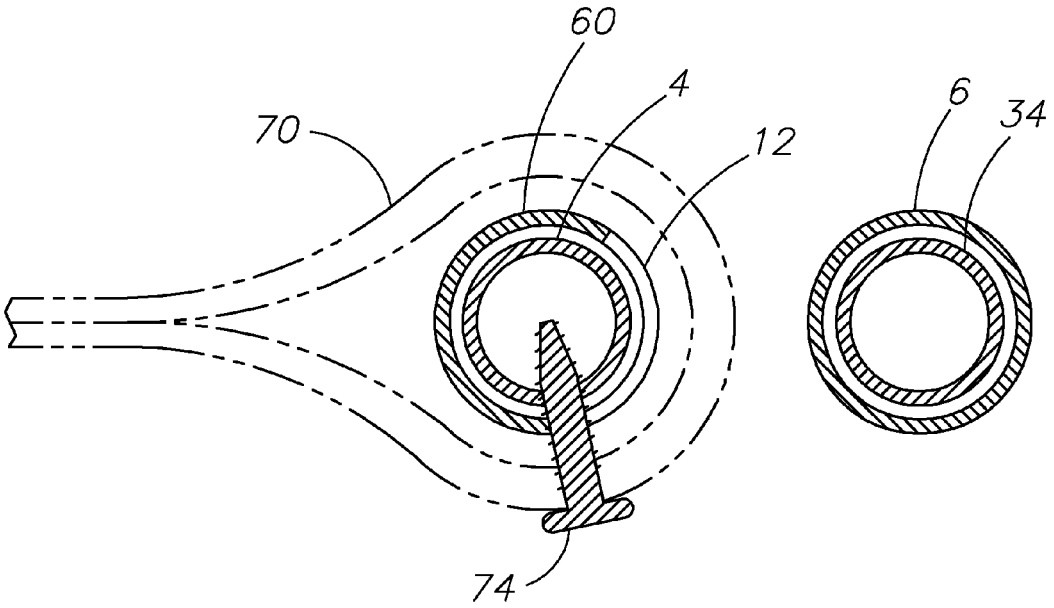
FIG. 4 is a sectional view of the connector taken generally along line 4 in FIG. 3.
Figure 5:
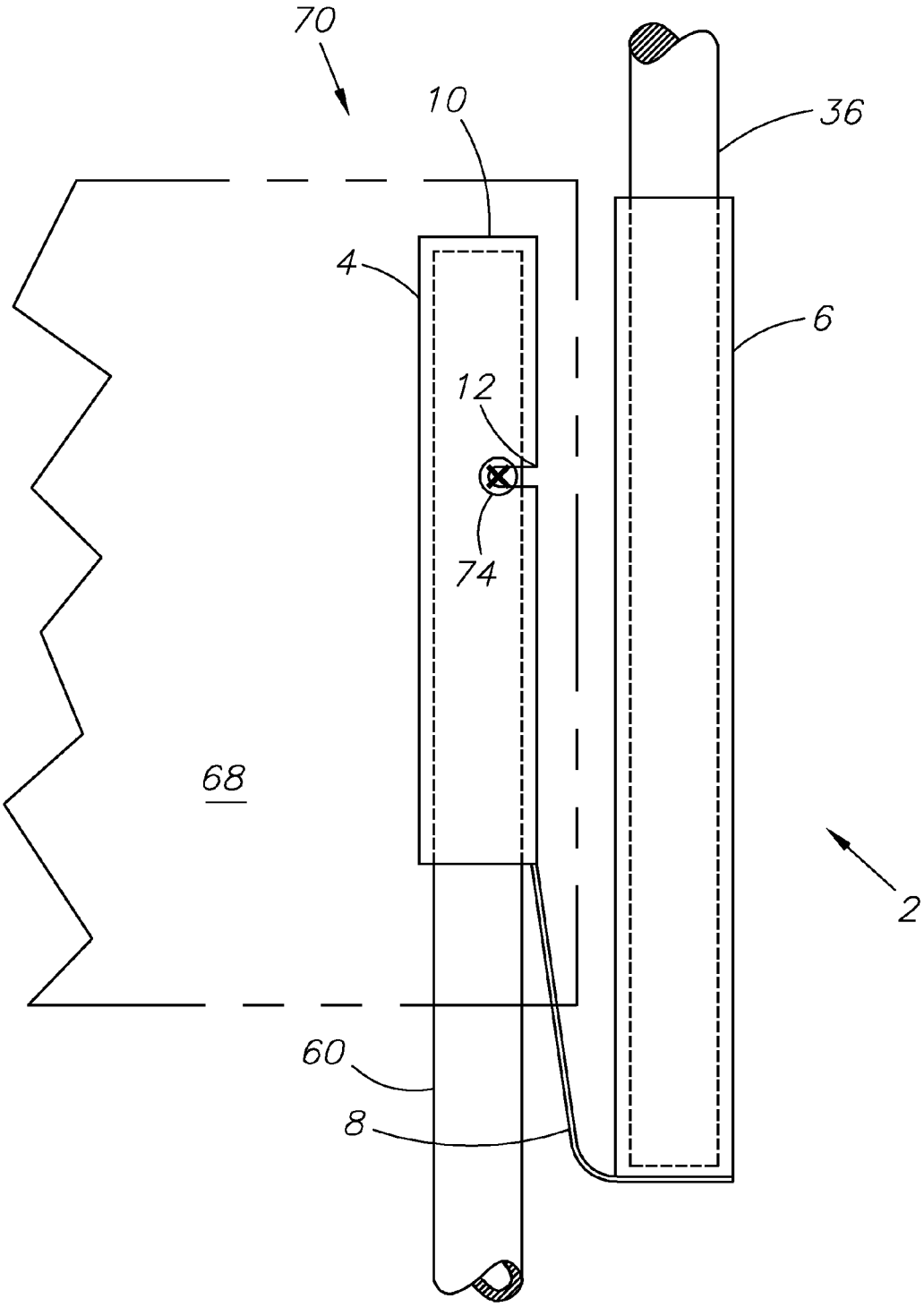
FIG. 5 is a rear elevation view of the connector including a post.

In FIGS. 1-3, an exemplary embodiment connector 2 has a ratchet hinge 32 installed in the receiving tube 6. The hinge 32 consists of a steel ratchet assembly 33 and steel first and second shafts 34, 35. The first shaft 34 is slidably received within the receiving tube 6, or may encompass the receiving tube 6 within. The receiving tube 6 and first shaft 34 may freely rotate about each other or preferably, are secured by a means suitable for the materials involved, such as welding. The hinge 32 is rotatable about the x and y plane for positioning of an item attached to the second shaft 35, such as a flag or an umbrella 56. Depending upon the item attached to the second shaft 35, the connector 2 can remain with the chair 52 during transportation and storage as described above by collapsing the hinge 32 whereby the second shaft 35 is orientated generally downward thereby positioning the first and second shafts 34, 35 next to each other. In FIG. 5, the connector 2, alternatively, has a post 36 installed in the receiving tube 6. As mentioned above, the post 36 can fit within or without the receiving tube 6, and can be permanently secured thereto, or permitted to rotate thereabout. A flag, umbrella, or other item attached to a post 36 can be installed in the receiving tube 6. Any item that is inserted into the receiving tube 6 that inhibits proper collapsing, transportation or storage of the chair 52 can be removed leaving the connector 2 installed on the chair 52.

III. Alternative Embodiment Connector 22

Figure 6:
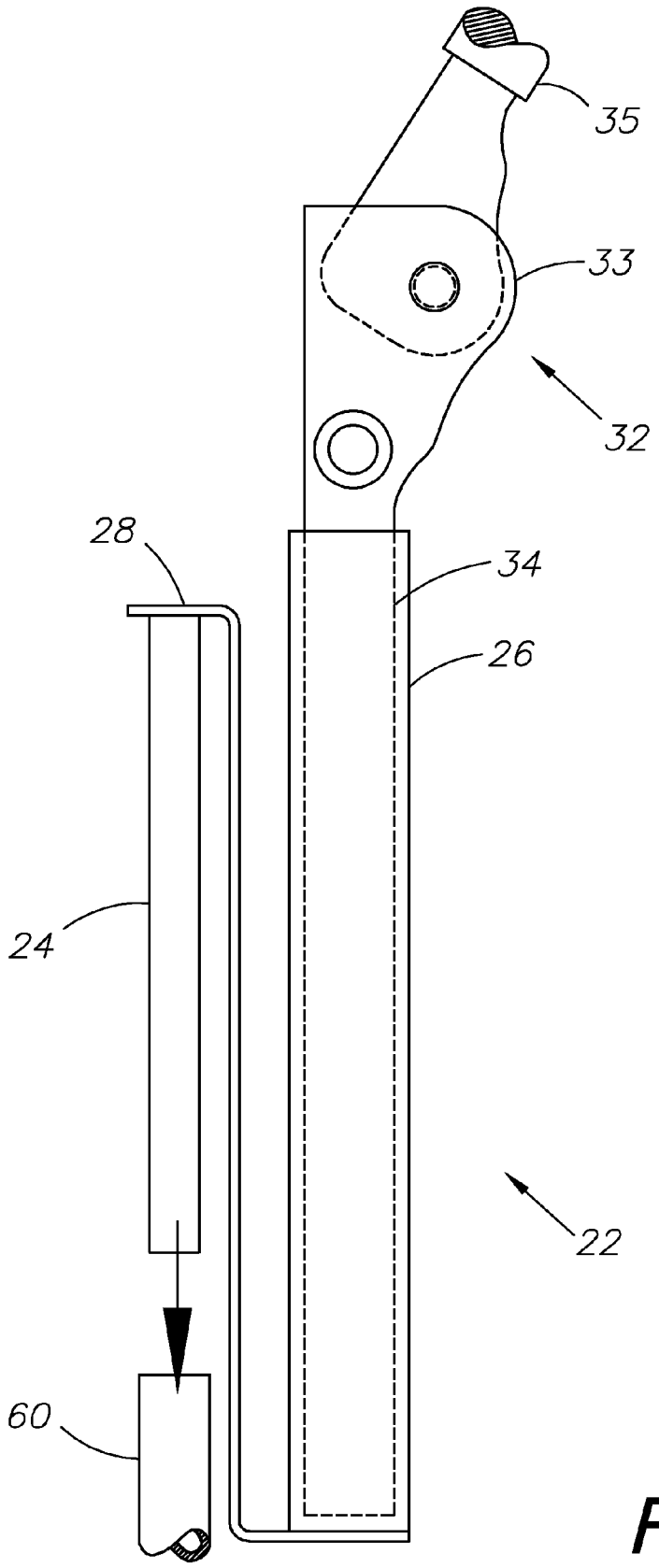
FIG. 6 is a rear elevation view of an alternative embodiment connector and ratcheted hinge.
Figure 7:
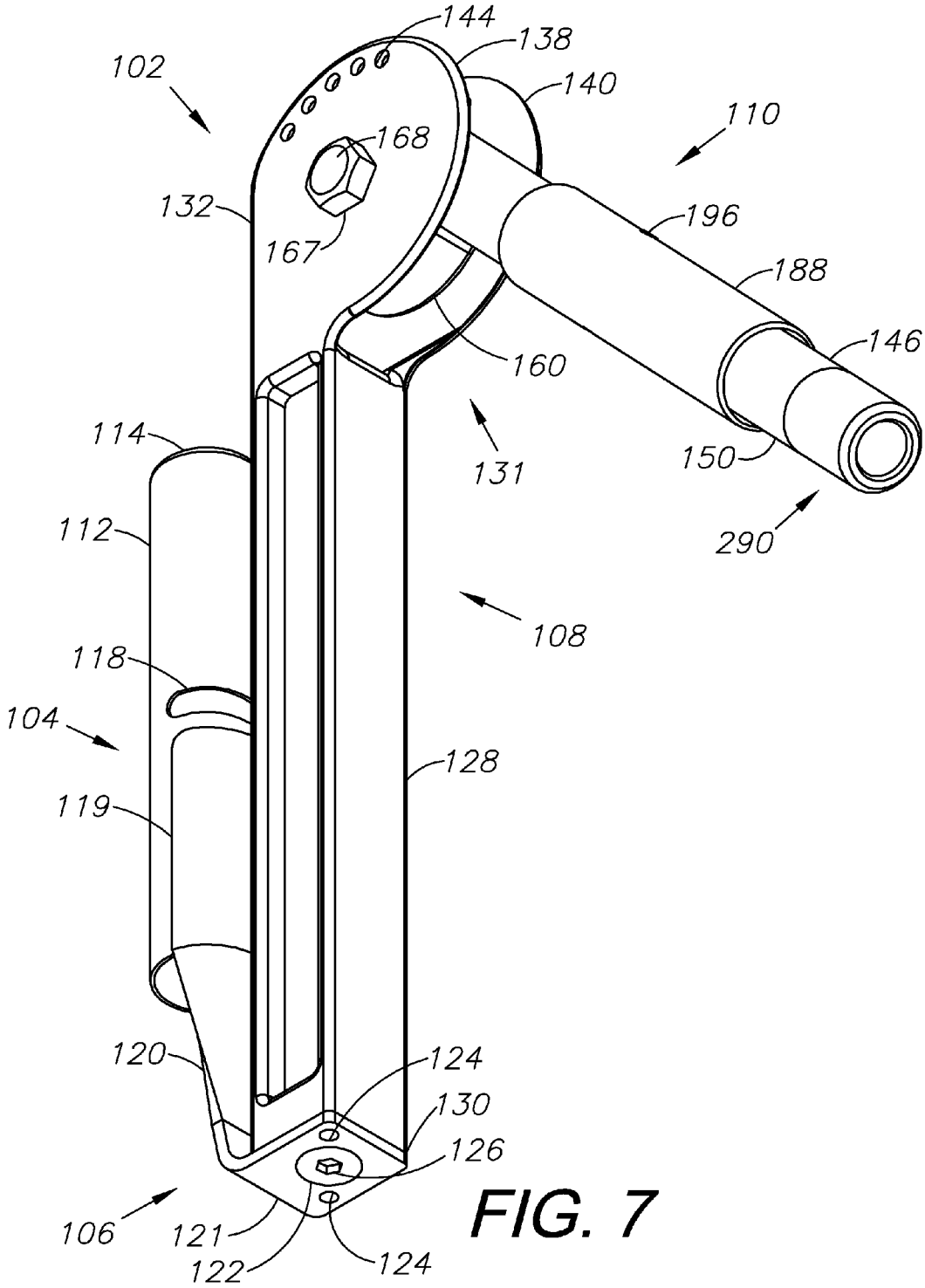
FIG. 7 is a right rear isometric view from below of an alternative embodiment connector embodying principles of the present invention.

Referring to FIG. 6, the reference numeral 22 generally designates an alternative embodiment adjustable connector similar to the connector 2 described above. The instant connector 22 is substantially similar in form and function to the connector 2 above, and is shown having a ratchet hinge 32 installed in the receiving tube 26. The connector 22 consists of an alternative mount such as a pin 24 and receiving tube 26 connected by a neck 28 manufactured from complementary materials such as metal, plastic or polymer, preferably galvanized steel.

The mounting pin 24 and receiving tube 26 are generally parallel and are connected by the neck 28. The mounting pin 24 is of a diameter that may be slidably received within the vertical support 60. The mounting pin 24 is shorter than the receiving tube 26 whereby the receiving tube 26 extends slightly above and substantially below the mounting pin 24.

The receiving tube 26 is open at the top end and sealed at the bottom end by a portion of the neck 28. The neck 28 has a generally S-shape and is welded to the bottom of the receiving tube 26 extending vertically, and slightly away from, the receiving tube 26 and attaching to the top of the mounting pin 24 by welding. The neck 28 extends horizontally over the top of the mounting pin 24, and is of a width that is greater than both the mounting pin 24 and vertical support 60.

It will be appreciated that the components of the connectors 2, 22 can be used for various other applications. Moreover, the connectors 2, 22 can be fabricated in various sizes and from a wide range of suitable materials, using various manufacturing and fabrication techniques.

IV. Alternative Embodiment Connector 102

Referring to FIGS. 7-26, the reference numeral 102 generally designates another alternative embodiment connector similar to the connector 2 described above. The connector 102 is of metal construction and consists of an arm assembly 110 and a frame 108 that rotate on a hinge 131. The frame 108 is generally parallel to a mount such as a tube 104 and is attached thereto by a bracket 106. The mounting tube 104 is attached to an elongated member such as the vertical support 60 of a chair 52. The arm assembly 110 is attached to an adapter 290 for connecting to a second elongated member such as an object (not shown) including, but not limited to the shaft 35 of an umbrella 56 as shown in FIG. 1 above, or a flag.

Figure 8:
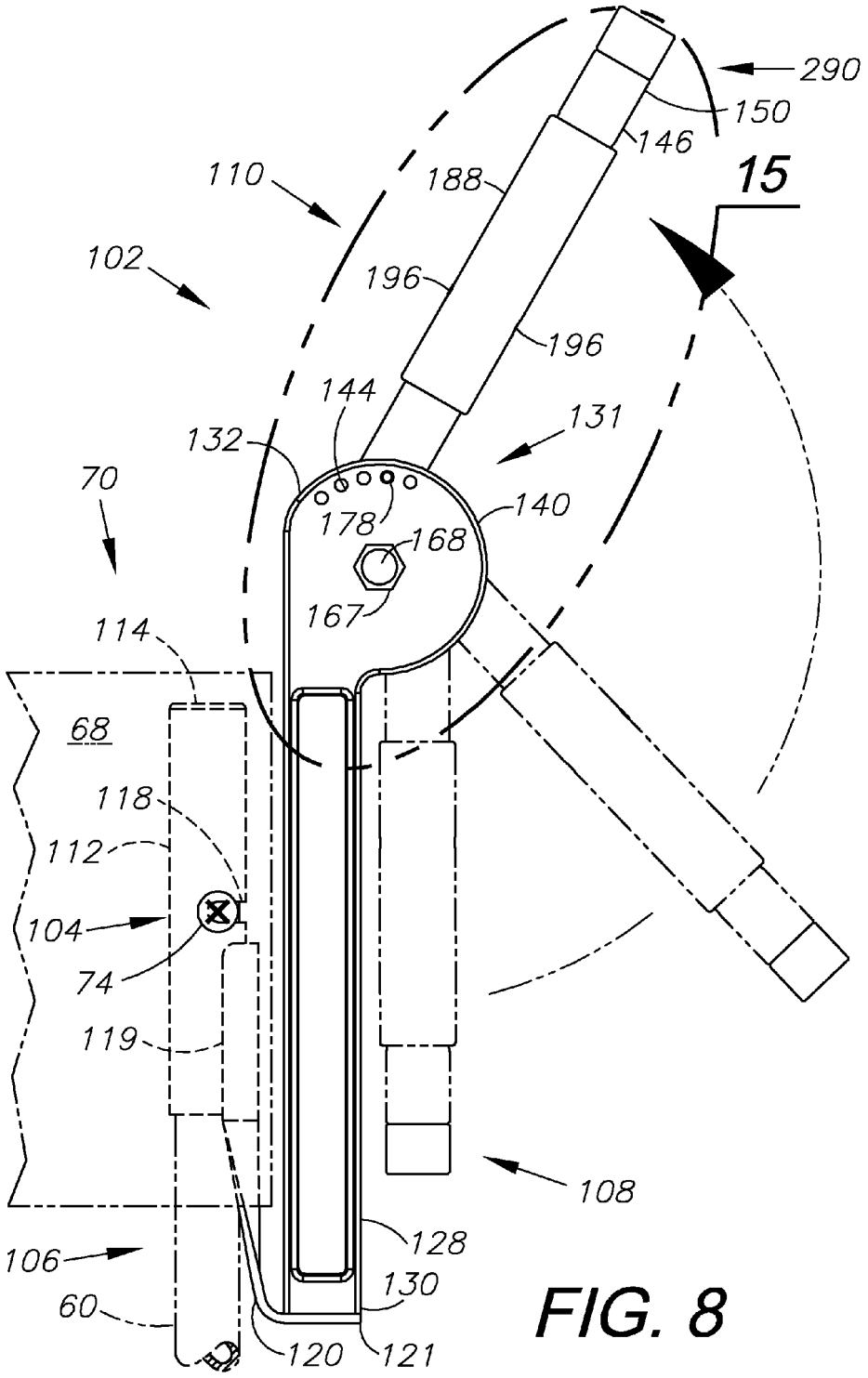
FIG. 8 is a rear elevational view of the connector attached to the vertical support of a chair, and an adapter attached to the support of an object.

Referring to FIG. 8, the connector 102 is shown mounted on a chair 52 as above. The connector 102 is installed on the chair 52 by removing the chair back 68 from the vertical support 60. A screw 74 securing the back 68 to the vertical support 60 is backed out of its receiver (not shown) and the back 68 is lifted off of the vertical support 60. The mounting tube 104 is slid over the vertical support 60 aligning the slot 118 with the receiver in the vertical support 60. The pocket 70 is then slipped over the mounting tube 104 and the screw 74 is reattached to the chair 52. The arm assembly 110 is then rotated up into the desired position. The position is fixed by the pegs 178 protruding from the arm assembly 110 engaging the register receivers 144 of the frame 108.

Figure 9:
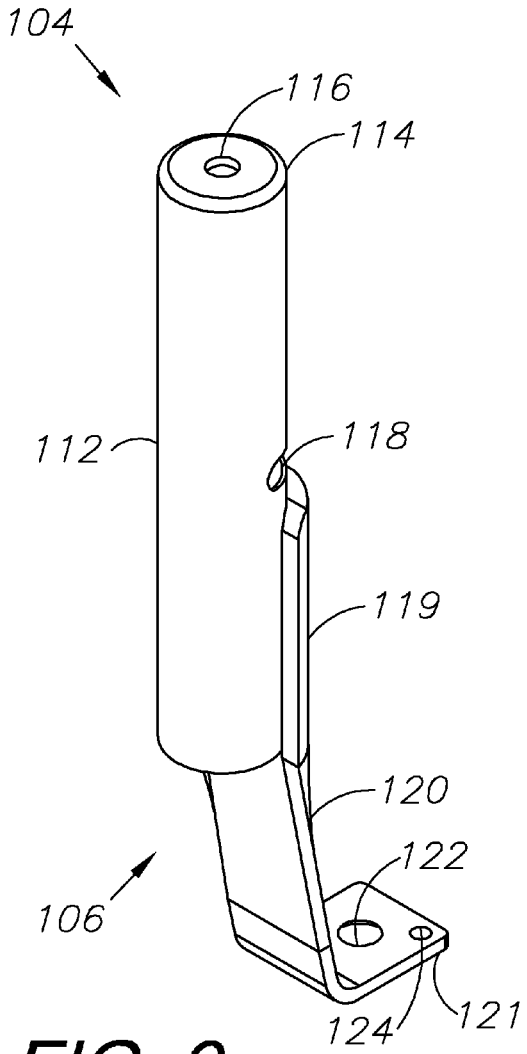
FIG. 9 is a left rear isometric view from above of the mounting tube.
Figure 11:
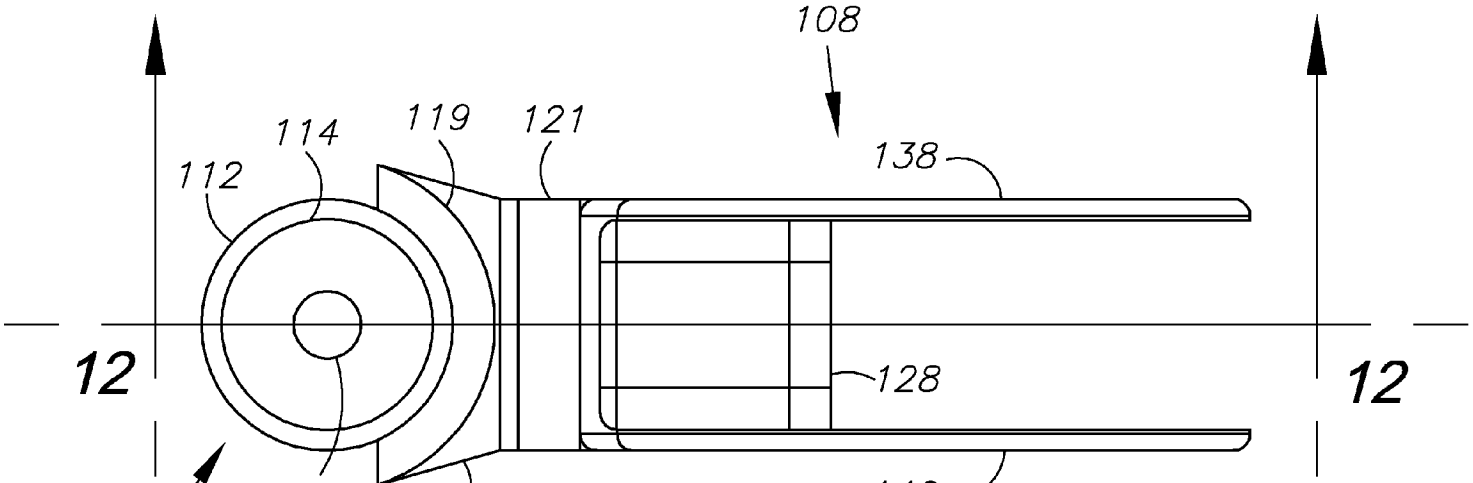
FIG. 11 is a top view of the frame.
Figure 20:
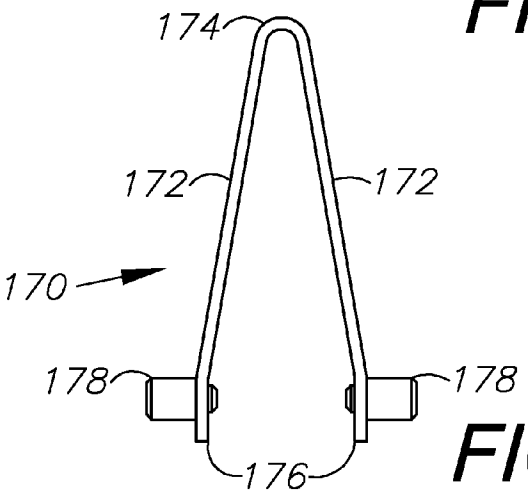
FIG. 20 is a plan view of the spring.
Figure 19:
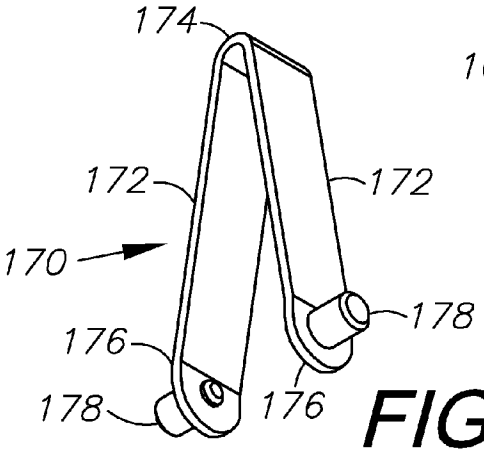
FIG. 19 is a left rear isometric view from above of the spring.
Figure 12:
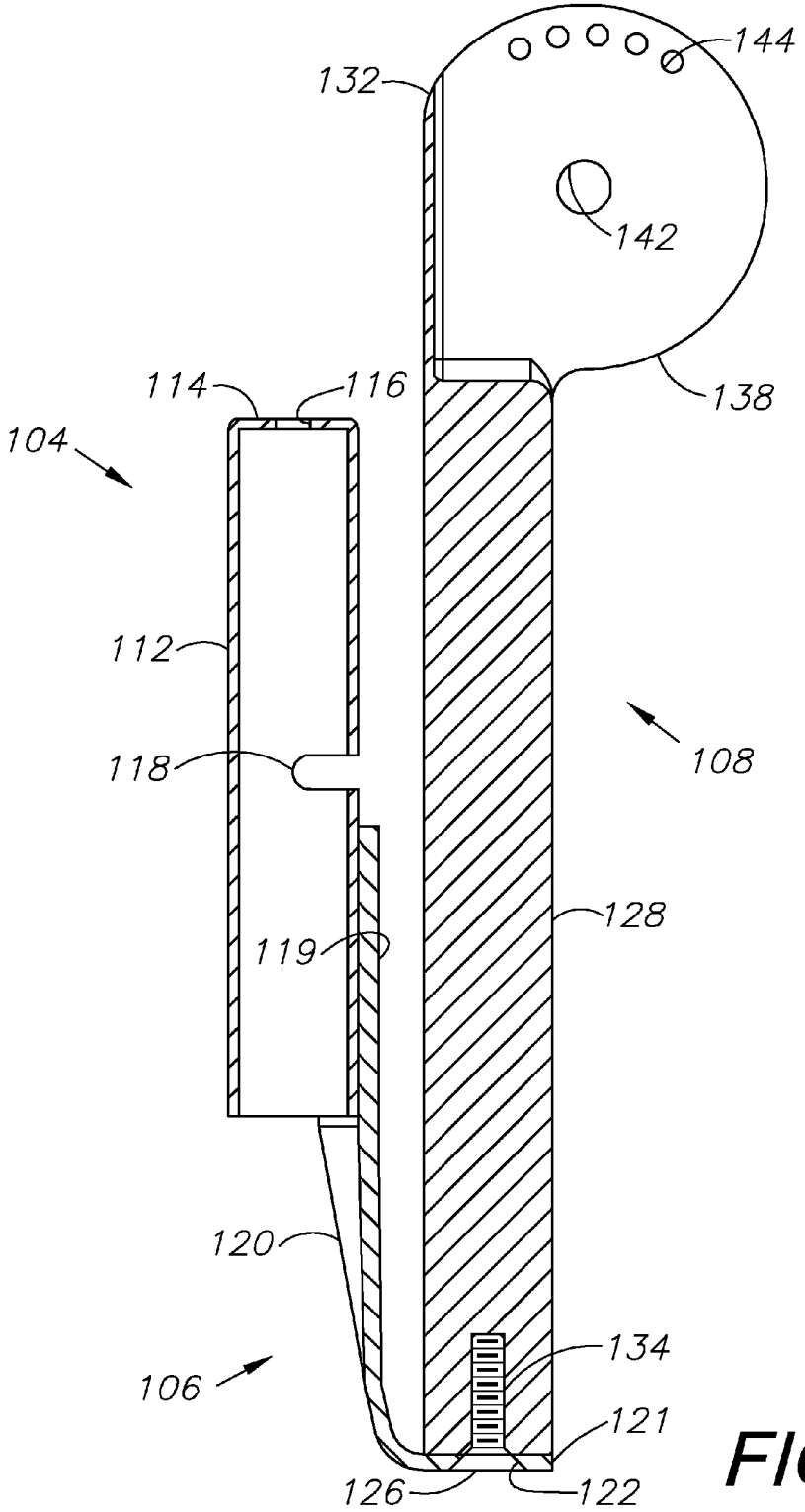
FIG. 12 is a sectional view of the frame taken along the line 12 in FIG. 11.
Figure 13:
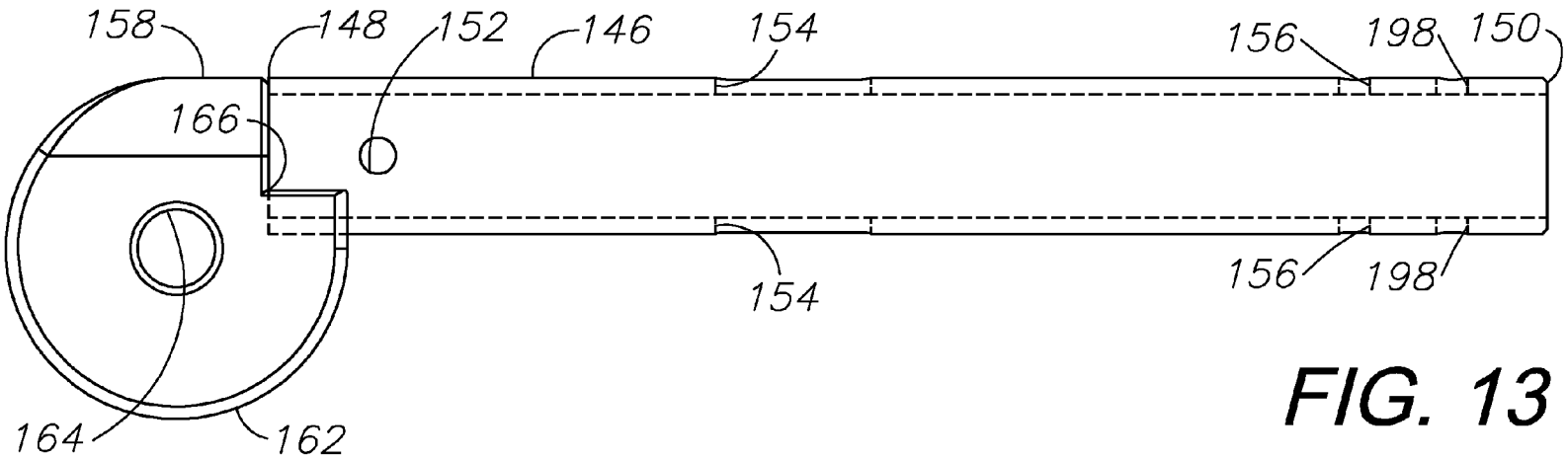
FIG. 13 is a rear elevational view of the arm.
Figure 14:
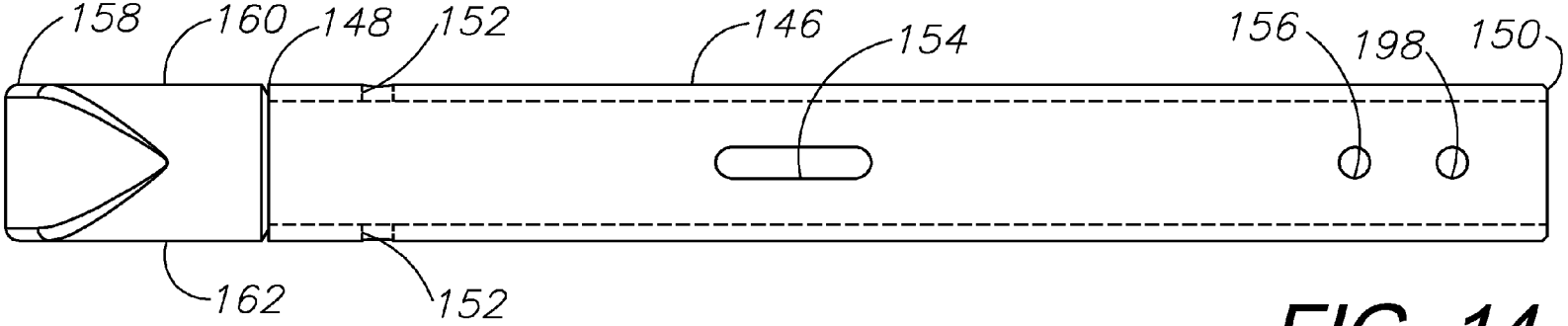
FIG. 14 is a plan view of the arm.

Referring to FIGS. 9 and 11-12, the mounting tube 104 is generally an elongated tubular body 112 manufactured from metal including, but not limited to, aluminum or steel, preferably steel. The body 112 is enclosed at the top by a cap 114 having an opening 116, and is open at the bottom for receiving the vertical support 60. The cap 114 is secured to the body 112 using suitable means such as welding. A slot 118 that is approximately fifty-percent of the body's 112 circumference is centered on the right side of the body 112. The slot 118 is located vertically on the body 112 to generally aligns with the receiver (not shown) in the vertical support 60 and permits reinsertion of the screw 74 thereby securing the back 68 to the chair 52 and permitting rotation of the connector 102 about the vertical support 60. Attached to the right side of the mounting tube 104 below the slot 118 is a bracket 106 having a generally L-shaped configuration. The bracket 106 may be manufactured from a complementary metal to that of the mounting tube 104 including, but not limited to aluminum or steel, preferably steel. The body 119 contours the mounting tube 104 and may be secured thereto by welding. The leg 120 of the bracket 106 extends down and away from the bottom of the mounting tube 104 at an obtuse angle terminating in a foot 121 that is generally perpendicular to the right side of the mounting tube 104. The mounting tube 104 and bracket 106 are separated a sufficient distance apart to permit reinstallation of the back 68 of the chair 52 as described above. The foot 121 may be either rectangular or circular, preferably rectangular. The foot 121 has a central opening 122 and one or more peripheral openings 124. The central opening 122 is dimensioned to pass a threaded fastener therethrough, such as a screw 126, for releasably mounting the bracket 106 to the bottom of the frame 108. The peripheral openings 124 are dimensioned to receive a pin (not shown) for mounting and proper alignment of the bracket 106 with the frame 108.

Figure 10:
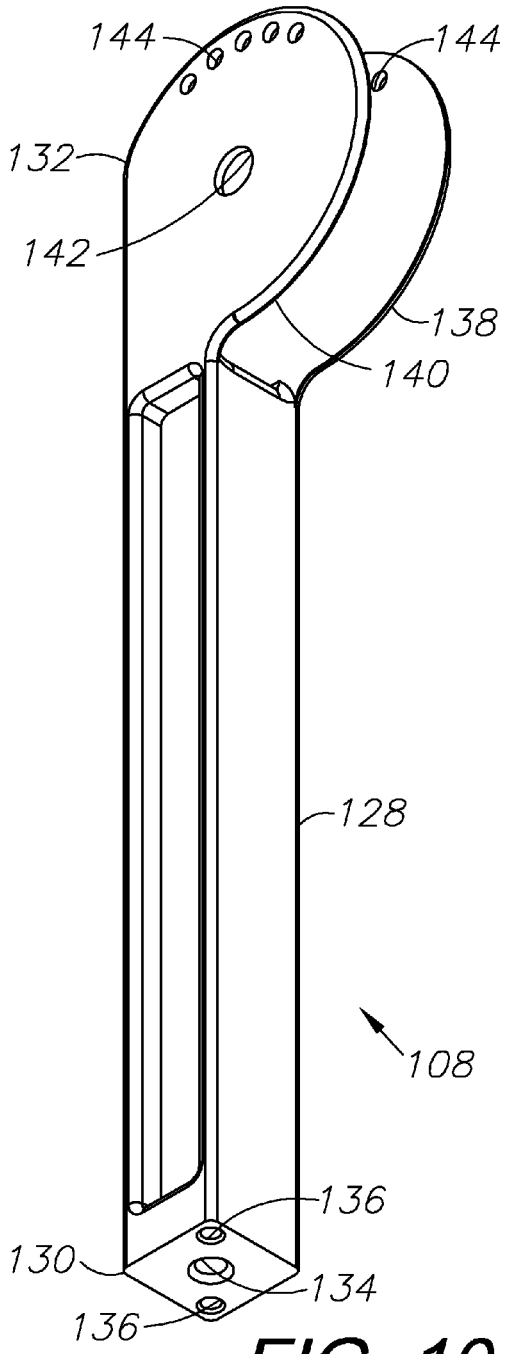
FIG. 10 is a right rear isometric view from below of the frame.

Referring to FIGS. 10-12, the frame 108 consists of an elongated body 128 having a clevis-shaped head 132 at a top end, and terminating at a base 130 at a bottom end. The frame 108 may be manufactured from metal including, but not limited to aluminum or steel, preferably aluminum. The base 130 has a threaded central receiver 134 for receiving a threaded fastener such as the screw 126, and one or more peripheral receivers 136 for securely receiving a pin (not shown) for mounting and proper alignment of the frame 108 with the bracket 106. The body 128 extends upward from the base 130 generally parallel to the mounting tube 104 and terminates in a clevis-shaped head 132 having a pair of generally circular front and back discs 138, 140. Each disc 138, 140 has a centrally located transverse pivot receiver 142 for receiving the pivot bolt 168, and a plurality of peripherally located register receivers 144 for slidably receiving the pegs 178 of the locking spring 170.

Referring to FIGS. 13-18, the arm assembly 110 consists of a hollow, elongated, tubular arm 146 having a nautilus-shaped hub 158 at one end, an internally located locking spring 170 and cam 180, and an externally located sleeve 188.

The arm 146 may be manufactured from metal including, but not limited to, aluminum or steel, preferably aluminum. The distal end 150 of the arm 146 is for receiving an adapter 290 that is used to connect to an object (not shown) including, but not limited to a flag or an umbrella. A pair of opposing receivers 198, located on the top and bottom of the arm 146 nearest the distal end 150, secure an fastener for securing the adapter 290 to the arm 146. The fastener may be a threaded fastener or an adapter pin 296. A pair of opposing receivers 156, proximal to the receivers 198, and located on the top and bottom of the arm 146 secure a spring pin 157. A pair of opposing, elongated slots 154 located on the top and bottom of the arm 146 are for slidably receiving a cam pin 197 that passes through both the sleeve 188 and the cam 180. The slots 154 are aligned along the length of the arm 146 approximately midway between the proximal 148 and distal 150 ends of the arm 146. A pair of opposing receivers 152 located on the front and back of the arm 146 nearest the proximal end 148 are for slidably receiving the pegs 178 of the locking spring 170. The hub 158 is generally a disc, having a width greater than or equal to the diameter of the tubular arm 146, and is manufactured from metal including, but not limited to, aluminum or steel, preferably aluminum. The hub 158 has a centrally located transverse receiver 164 for receiving the pivot bolt 168 passing through the front and back faces 160, 162, and a notch 166 for receiving the proximal end 148 of the arm 146. The notch 166 permits the proximal end 148 of the arm 146 to be cradled by the hub 158, and for the arm 146 to extend away from the hub 158 whereby the top surface of the arm 146 defines a ray that is tangent to the perimeter of the hub 158. The hub 158 and arm 146 are fixedly secured together by welding or other suitable means.

Figure 15:
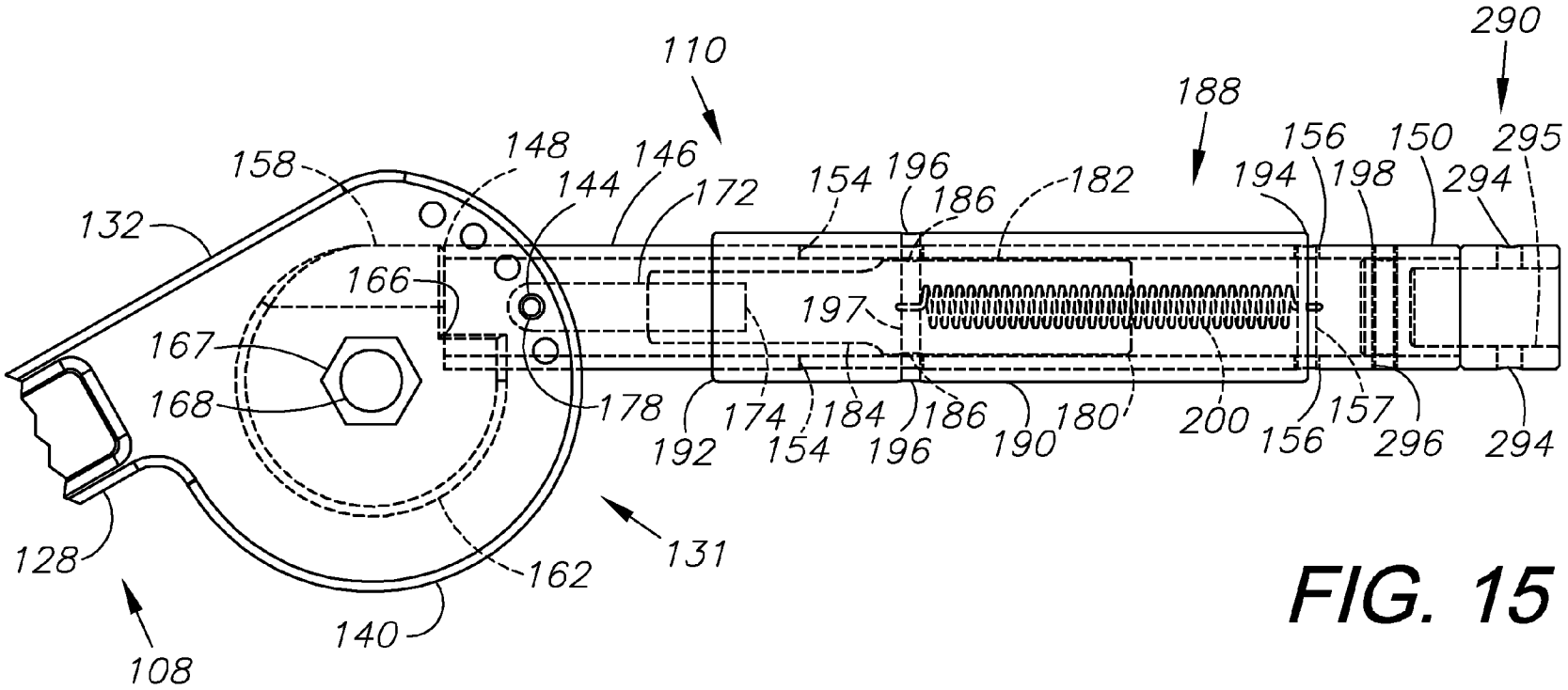
FIG. 15 is a rear elevational view of the arm assembly taken generally within the circle 15 in FIG. 8.

Referring to FIGS. 15-26, the arm assembly 110 and its various components will be shown and described. FIG. 15 is an enlarged fragmentary view of the frame 108 and arm assembly 110 showing in particular the arm 146 with an internally located locking spring 170, cam 180 and return spring 200, and an externally located sleeve 188. The arm assembly 110 and frame 108 are joined by a nut 167 and bolt 168 combination permitting free rotation of the arm assembly 110 about the bolt 168. The cam pin 197 is shown passing through the slots 154 in the arm 146, the receivers 196 in the sleeve 188, and the receivers 186 in the cam 180, thereby connecting the sleeve 188 and cam 180 together, and permitting them to slide together along the length of the slot 154. The return spring 157 is shown attached to both the cam pin 197 and spring pin 157. The spring pin 157 is shown secured within the receivers 156 in the arm 146. The pegs 178 of the locking spring 170 are shown engaging a pair of register receivers 144 in the head 132.

Figure 16:
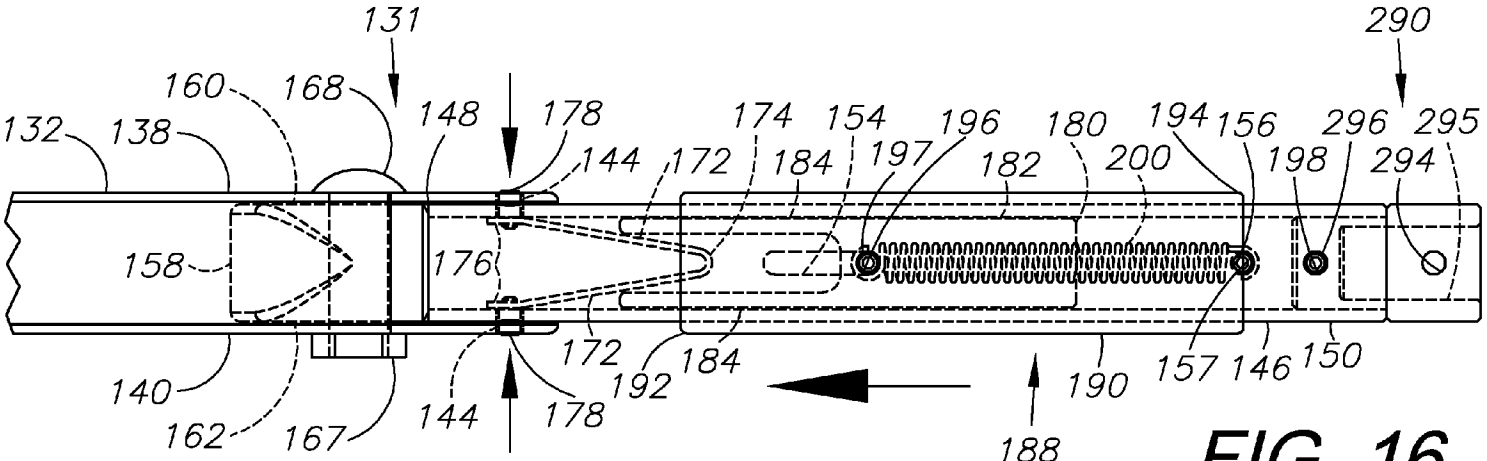
FIG. 16 is a plan view of the arm assembly showing the spring pins engaging the index receivers of the frame.
Figure 17:
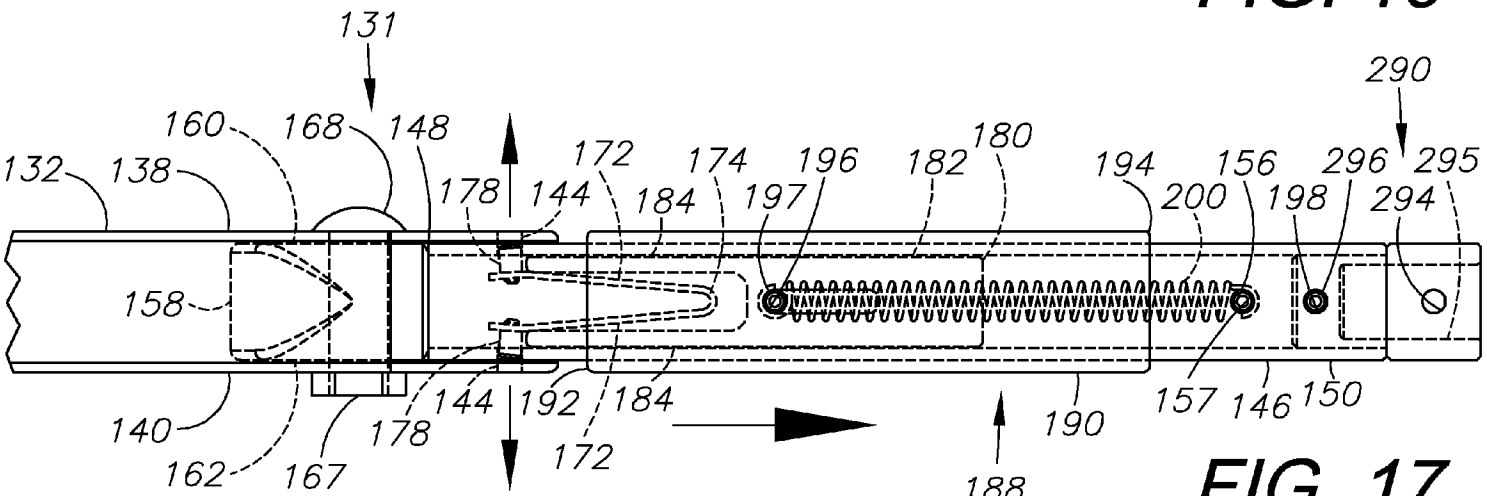
FIG. 17 is a plan view of the arm assembly showing the spring pins disengaged from the index receivers of the frame.
Figure 18:
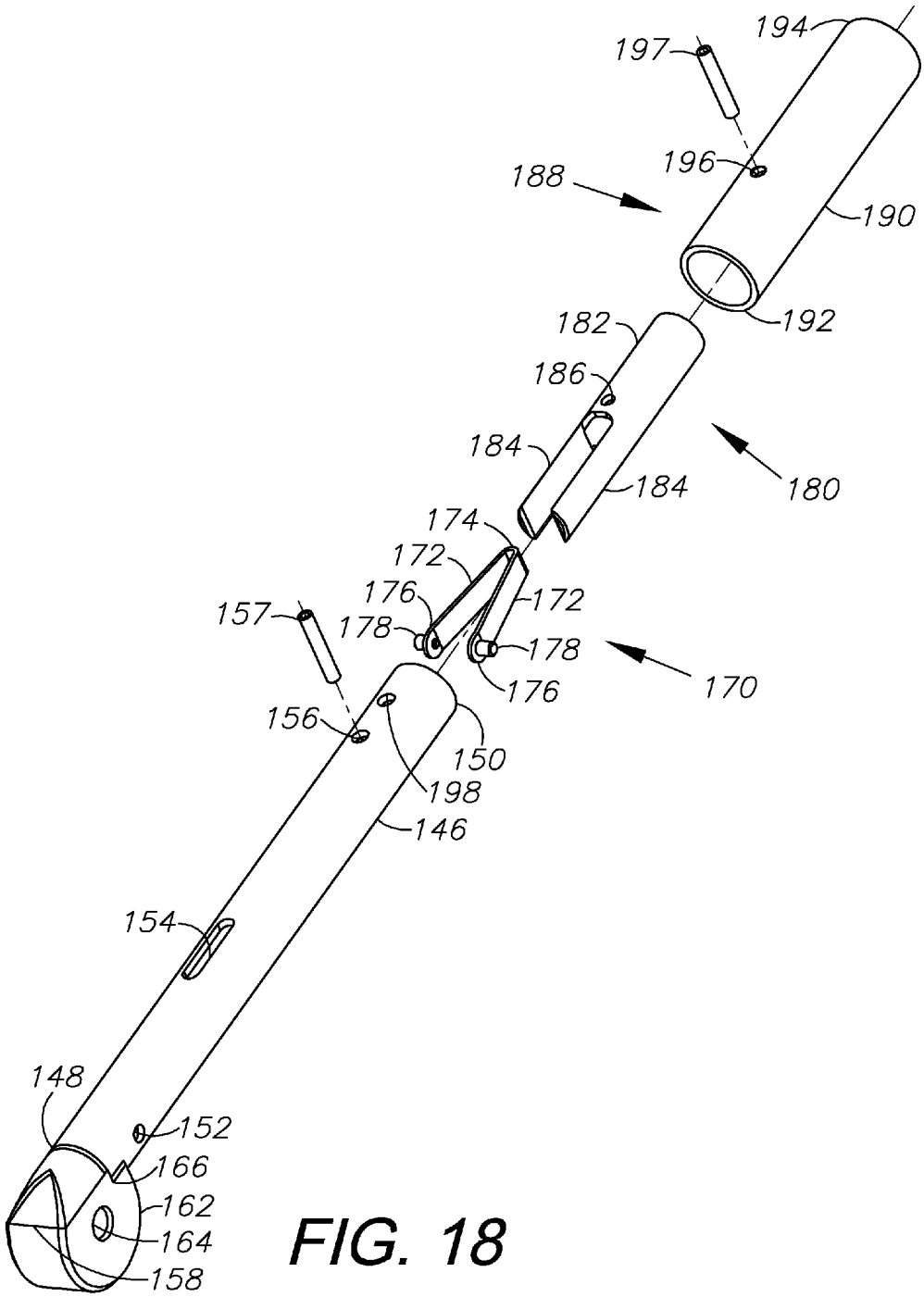
FIG. 18 is a left rear isometric exploded view from above of the arm assembly.
Figure 23:
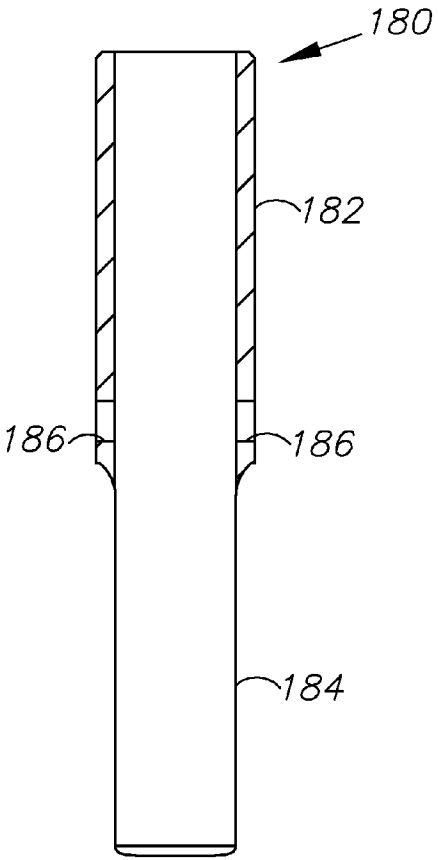
FIG. 23 is a sectional view of the cam taken along the line 23 in FIG. 21.
Figure 22:
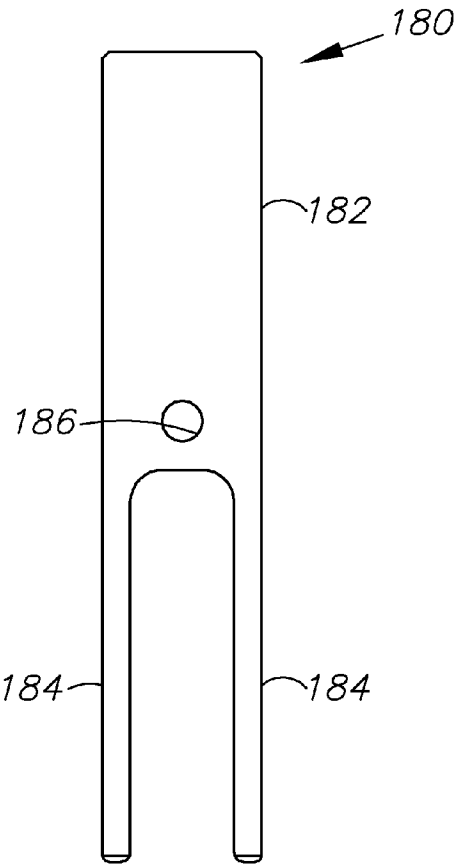
FIG. 22 is a plan view of the cam.
Figure 21:
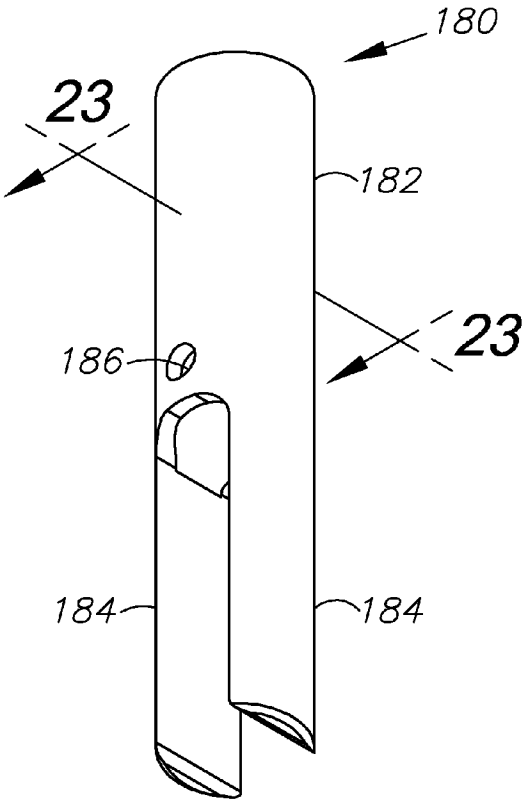
FIG. 21 is a left rear isometric view from above of the cam.
Figure 26:
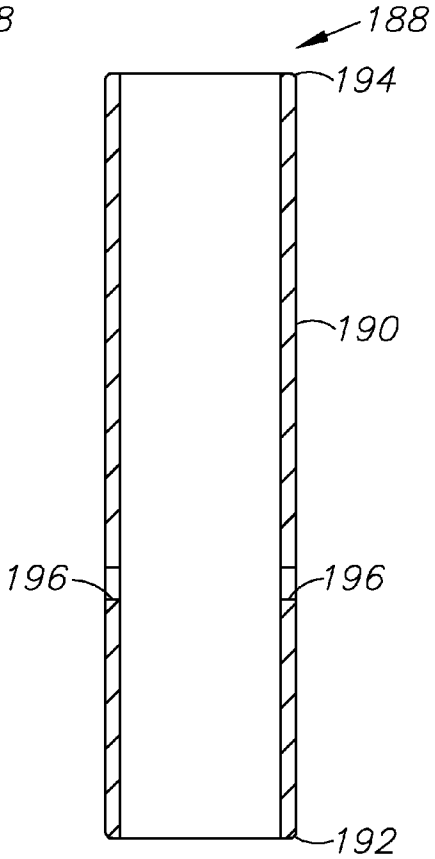
FIG. 26 is a sectional view of the sleeve taken along the line 26 in FIG. 24.
Figure 25:
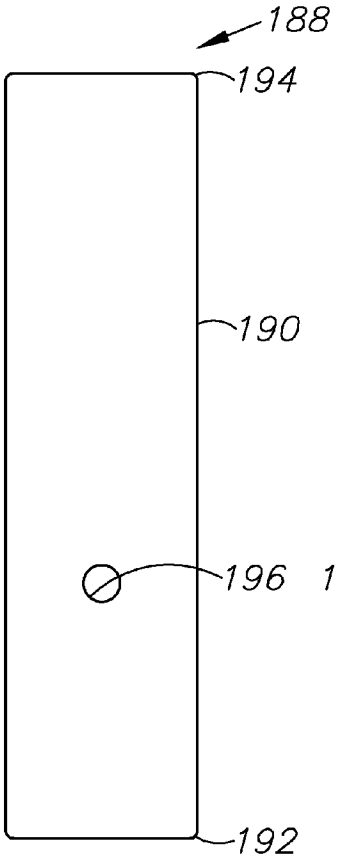
FIG. 25 is a plan view of the sleeve.
Figure 24:
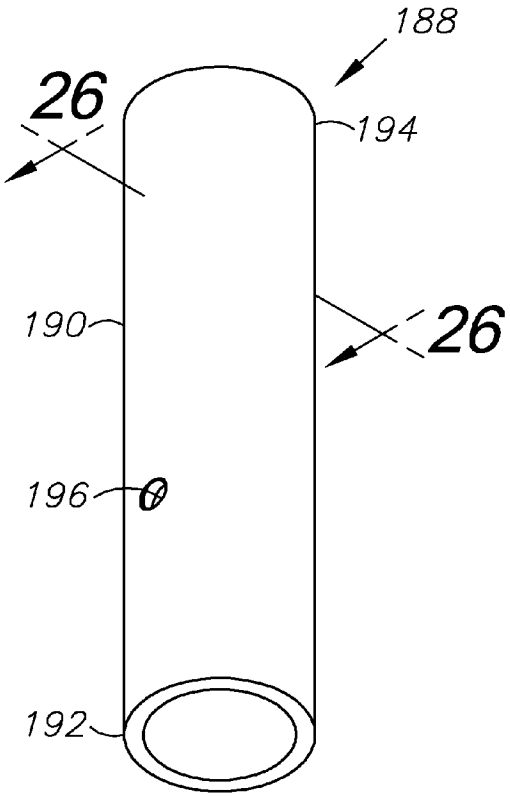
FIG. 24 is a left rear isometric view from above of the sleeve.
Figure 27:
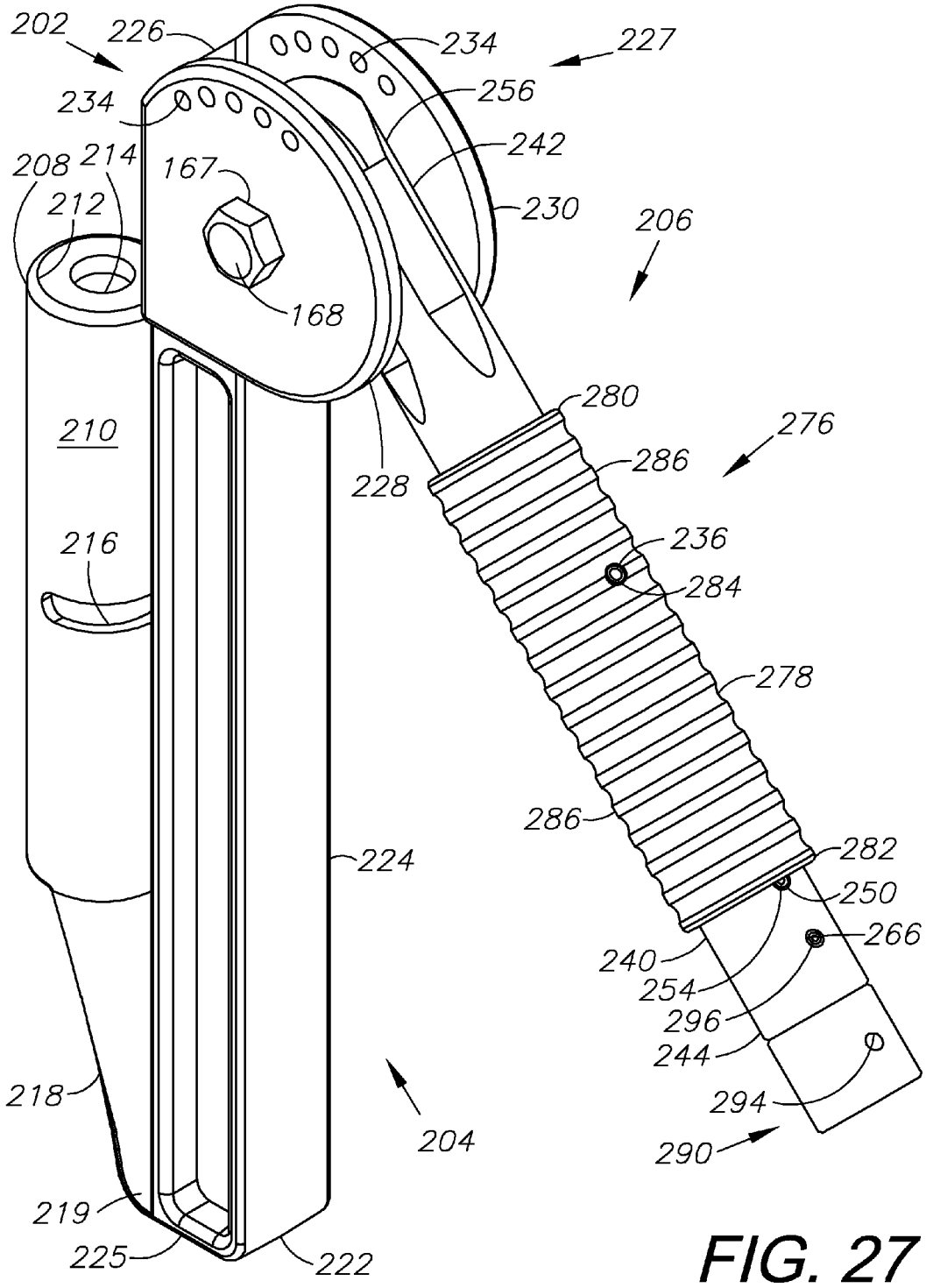
FIG. 27 is a right rear isometric view from above of an alternative embodiment connector embodying principles of the present invention.

FIGS. 16-18 show a top view of the arm assembly 110 and how the sleeve 188 and cam 180 cooperate to disengage the pegs 178 from the register receivers 144 enabling repositioning of the arm assembly 110. FIG. 16 shows the arm assembly 110 in a fixed position whereby the pegs 178 of the locking spring 170 are engaging the register receivers 144 of the head 132. The locking spring 170 (FIGS. 19-20) is generally V-shaped having feet 176 with outward facing pegs 178 extending therefrom. Elongated legs 172 extend up from the feet 176 terminating at a head 174. The spring locking 170 is dimensioned to fit within the arm 146 and may be manufactured from metal including, but not limited to, aluminum or steel, preferably steel. The locking spring 170 is compressed by the pinching force of the cam caused by the inner surface of the legs 184 sliding toward the proximal end 148 of the arm 146 thereby bringing the legs 172 and feet 176 together. The cam 180 (FIGS. 21-23) is generally a hollow tube having an elongated body 182 with a transverse receiver 186 dimensioned to slidably receive the cam pin 197, and opposite legs 184 depending therefrom. The cam 180 is dimensioned to slidably fit within the arm 146 and may be manufactured from metal including, but not limited to, aluminum or steel, preferably aluminum. The legs 184 are oriented whereby the head 174 of the locking spring 170 passes between the legs 184, and the inner surface of the legs 184 engage the legs 172 of the locking spring 170. The sleeve 188 (FIGS. 24-26) is a hollow tube with an elongated body 190 dimensioned to slide along the exterior of the arm 146. The sleeve 188 may be manufactured from metal including, but not limited to aluminum or steel, preferably aluminum. The sleeve 188 is open at the proximal 192 and distal 194 ends and has transverse opposing receivers 196 passing therethrough located near the proximal end 192 and dimensioned to securely receive the cam pin 197. The sleeve 188 is mounted on the arm 146 with the proximal end 192 orientated toward the proximal end 148 of the arm 146. A metal helical return spring 200 is dimensioned to slidably fit within the cam 180 and attach to the cam pin 197 and spring pin 157. The return spring 200 is under tension when the cam 180 and sleeve 188 are in their distal most position relative to the hub 158, and has sufficient force to return the cam 180 and sleeve 188 to their distal positions after being drawn to their proximal end 148 of the arm 146 and released.

The adapter 290 (FIGS. 7-8, 15-17, and 44-47) is generally a stepped cylinder having a proximal end 291 that is less in diameter than the distal end 292. The adapter 290 may be manufactured from a variety of materials including, but not limited to metal, steel, aluminum, plastic, or acetal plastic, preferably aluminum. The proximal end 291 is dimensioned to slidably fit within the arm 146. An arm receiver 293 passes from the top to the bottom of the adapter 290. The adapter 290 is mounted to the arm assembly 110 by aligning the arm receivers 293 with the receivers 198 on the distal end of the arm 146 and secured therethrough using a fastener including, but not limited to a threaded fastener or an adapter pin 296. A cavity 295 extends from the distal end 292 into the proximal end 291 of the adapter 290 for receiving a support (not shown) such as the shaft 35 in FIG. 1 for an object (not shown). The support is secured to the adapter 290 by inserting a fastener through the object receiver 294 and into the support.

The adjustment of the arm assembly 110 is accomplished by mechanical operation of the sleeve 188 compressing the locking spring 170 causing the pegs 178 to disengage the register receivers 144. The mechanical force of the locking spring 170 returning to an uncompressed state keeps the pegs 178 engaged with the register receivers 144. When the pegs 178 are engaged, the legs 184 of the cam 180 do not pinch the legs 172 of the locking spring 170 sufficiently to cause the pegs 178 to disengage the register receivers 144. Moving the sleeve 188 toward the proximal end 148 of the arm 146 causes the cam 180 to move an equal distance toward the proximal end 148 of the arm 146 whereby the legs 172 of the cam 180 slide along the legs 172 of the locking spring 170 biasing the feet 176 inward, toward each other and drawing the pegs 178 out of engagement with the register receivers 144. Once the pegs 178 are disengaged, the arm assembly 110 may be rotated to engage a different set of register receivers 144, or may be rotated down into a collapsed position whereby the arm assembly 110 and the body 128 of the frame 108 are adjacent and substantially parallel. Rotating the arm assembly 110 into a collapsed position enables the connector 102 or any object connected to it, to remain attached to the chair 52 when the chair 52 is collapsed for storage. When the sleeve 188 is not being held in proximity to the proximal end 148 of the arm 146, the desire of the locking spring 170 to return to an uncompressed state forces the pegs 178 to engage the register receivers 144. The cam 180 and sleeve 188 return to a position in proximity to the distal end 150 of the arm 146 by the return spring 200.

V. Alternative Embodiment Connector 202

Referring to FIGS. 27-43, the reference numeral 202 generally designates another alternative embodiment connector similar to the connectors 2 and 102 described above. The majority of the connector 202 is manufactured from non-metallic materials and consists of an arm assembly 206 and a plastic mounting bracket assembly 204 that rotate on a hinge 227.

Figure 28:
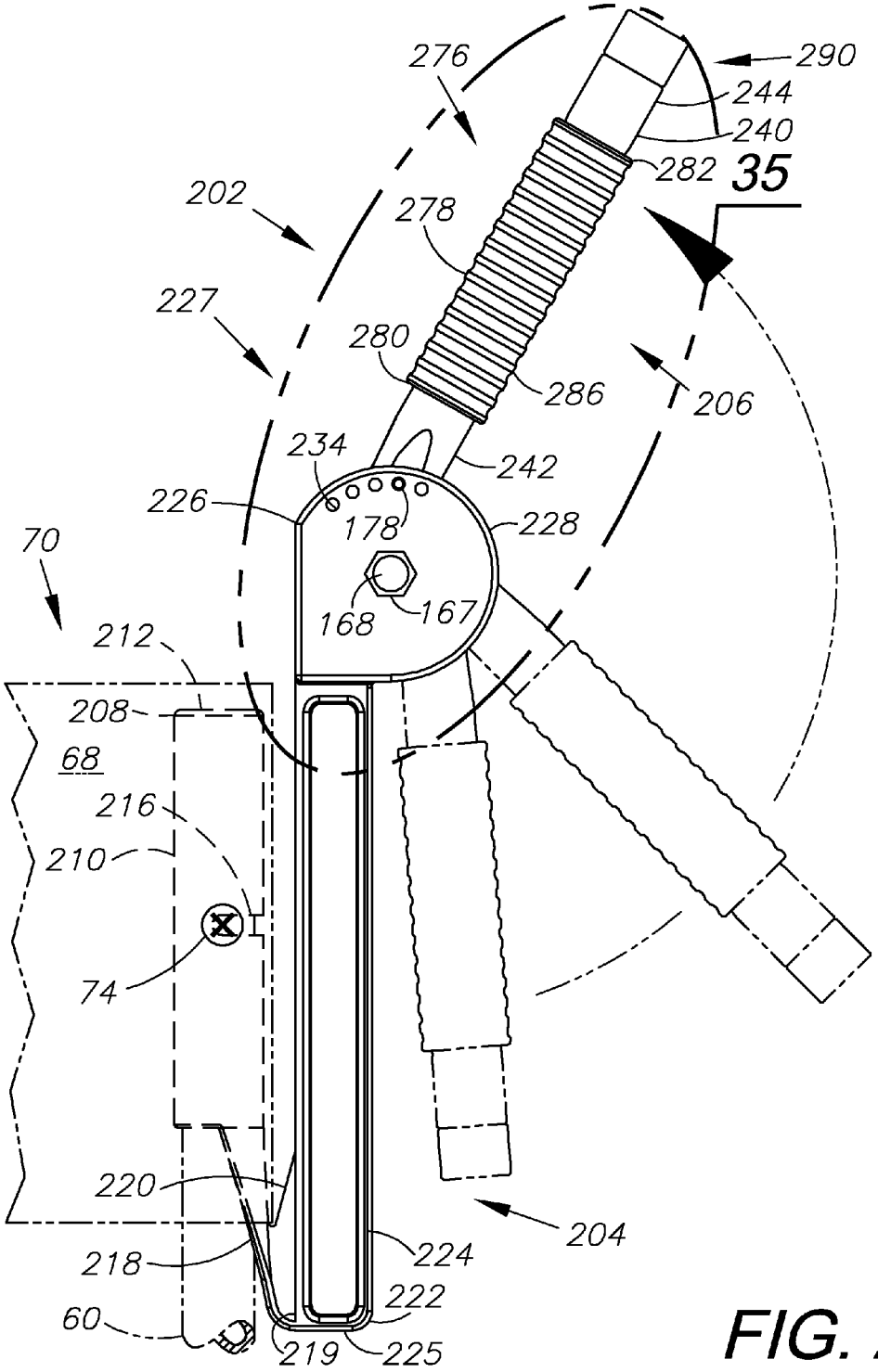
FIG. 28 is a rear elevational view of the connector attached to the vertical support of a chair, and an adapter attached to the support of an object.

Referring to FIG. 28, the connector 202 is shown mounted on a chair 52. The connector 202 is installed on the chair 52 by removing the chair back 68 from the vertical support 60. A screw 74 securing the back 68 to the vertical support 60 is backed out of its receiver (not shown) and the back 68 is lifted off of the vertical support 60. The mounting tube 208 is slid over the vertical support 60 aligning the slot 216 with the receiver in the vertical support 60. The pocket 70 is then slipped over the mounting tube 208 and the screw 74 is reattached to the chair 2. The arm assembly 206 is then rotated up into the desired position. The position is held fixed by the pegs 178 protruding from the arm assembly 206 engaging the register receivers 234 of the frame 222.

Figure 29:
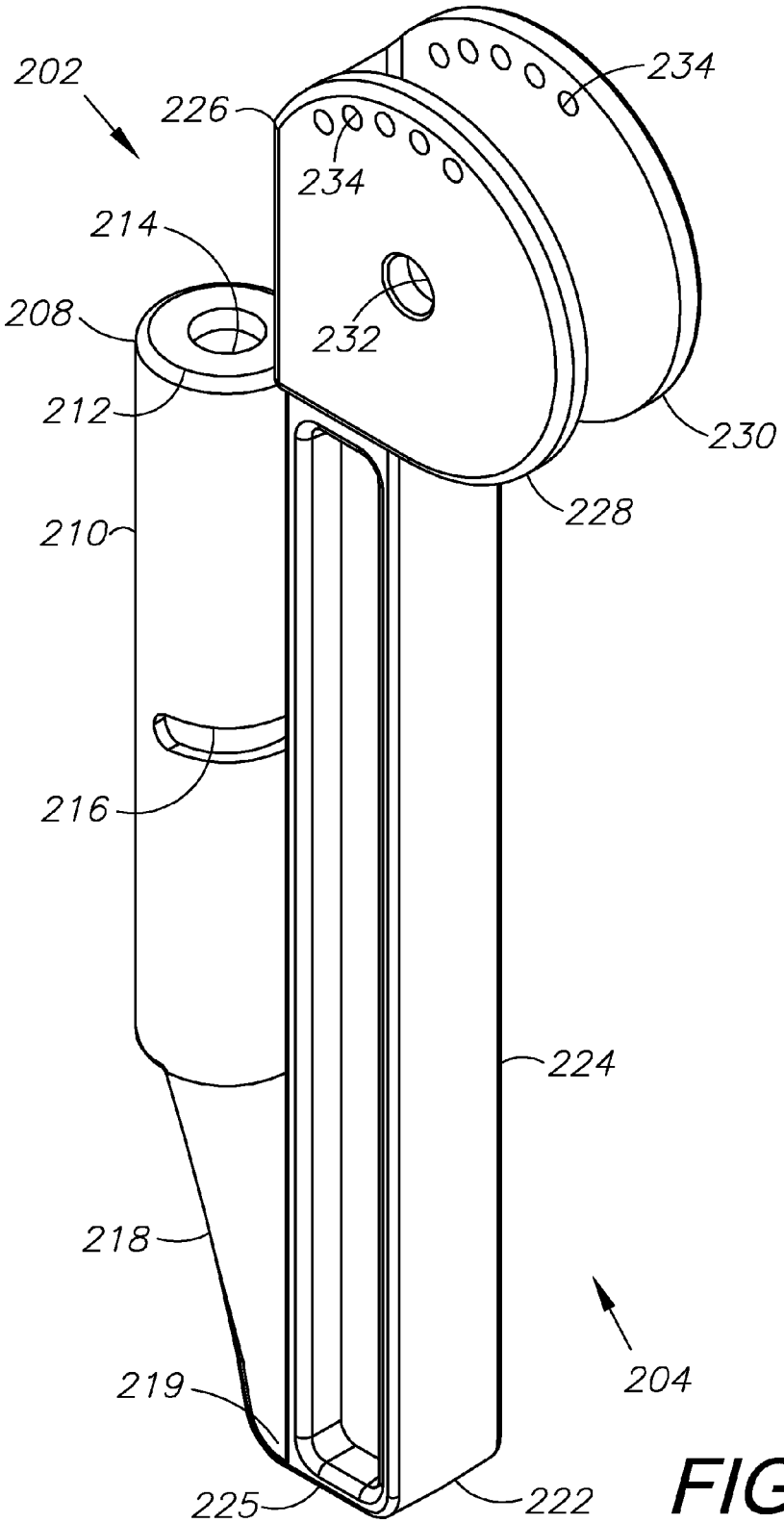
FIG. 29 is a right rear isometric view from above of the mounting tube and frame assembly.
Figure 42:
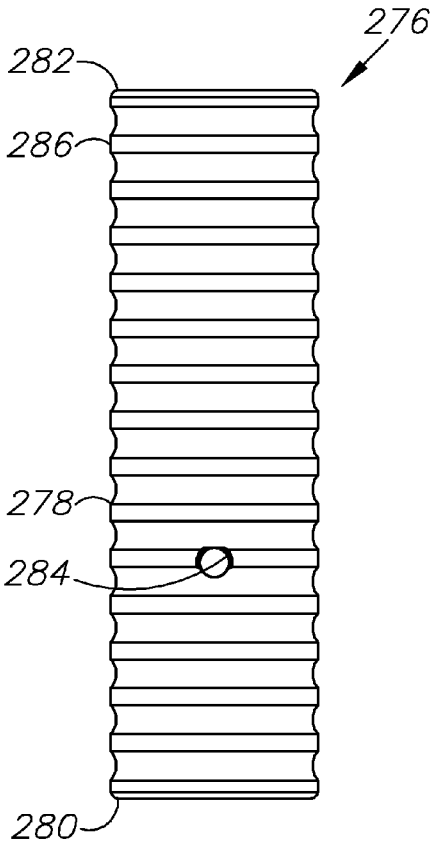
FIG. 42 is a plan view of the sleeve.
Figure 43:
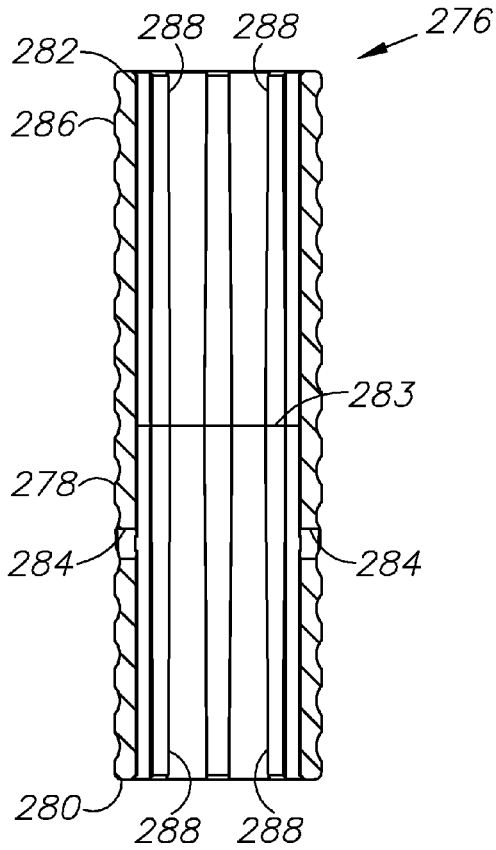
FIG. 43 is a sectional view of the sleeve along the line 43 in FIG. 41.
Figure 30:
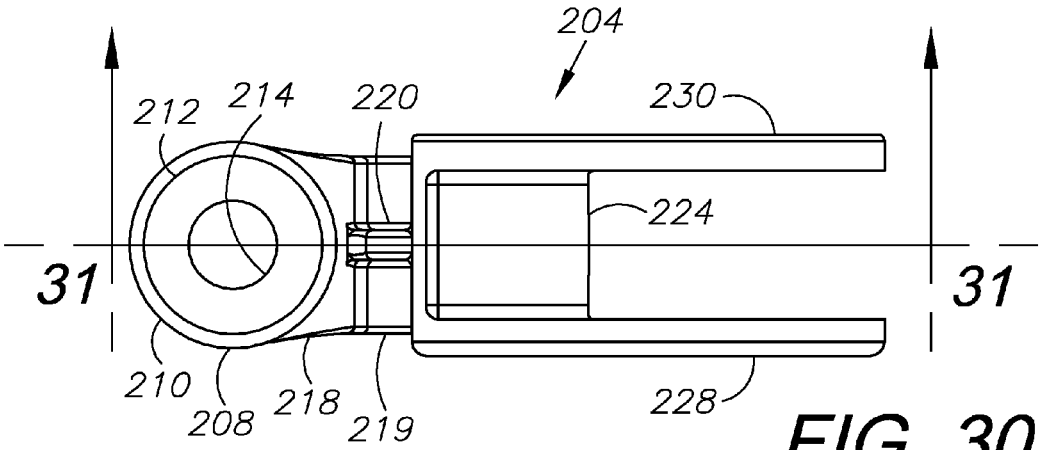
FIG. 30 is a plan view of the mounting tube and frame assembly.
Figure 31:
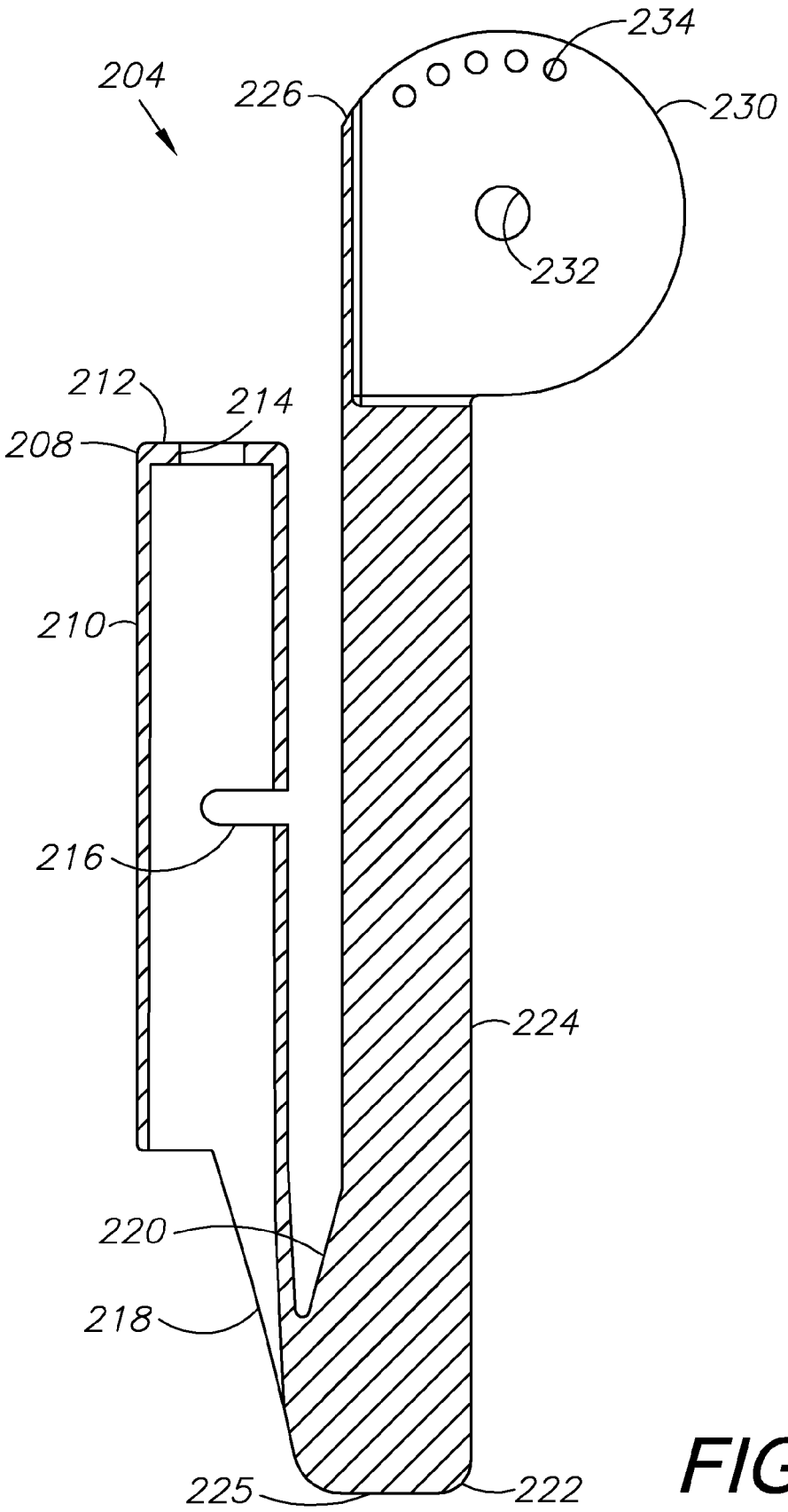
FIG. 31 is a sectional view of the mounting tube and frame assembly taken along the line 31 in FIG. 30.

Referring to FIGS. 29-31, the mounting bracket assembly 204 is manufactured from plastic, preferably acetal plastic. An elongated tubular mounting tube 208 on the left side of the mounting bracket assembly 204 has a body 210 enclosed at the top by a cap 212 having an opening 214, and is open at the bottom for receiving the vertical support 60. A slot 216 that is approximately fifty percent of the body's 210 circumference is centered on the right side of the body 210. The slot 216 is located vertically on the body 210 to align with the receiver in the vertical support 60 and permits reinsertion of the screw 74 thereby securing the back 68 to the chair 52 and permitting rotation of the connector 202 about the vertical support 60. A tail 218 descending from the bottom of the body 210 tapers from a semi-circular wide upper end portion to a relatively narrow and flat lower portion terminating as the base 225 of the frame 222. A web 220 extending between the tail 218 and body 224 begins at the saddle 219 and tapers from a broad lower end portion to a triangular upper end portion blending into the lower left portion of the body 224 providing additional structural support. The body 224 extends upward from the base 225 generally parallel to the mounting tube 208 and terminates in a clevis-shaped head 226. The head 226 has a pair of generally circular front and back discs 228, 230. Each disc 228, 230 has a centrally located transverse pivot receiver 232 for receiving the pivot bolt 168, and a plurality of peripherally located register receivers 234 for slidably receiving the pegs 178 of the locking spring 170.

Referring FIGS. 32-37, the arm assembly 206 consists of a hollow elongated tubular arm 240 having a nautilus-shaped hub 238 at one end, an internally located locking spring 170 and cam 268, and an externally located sleeve 276.

Figure 32:
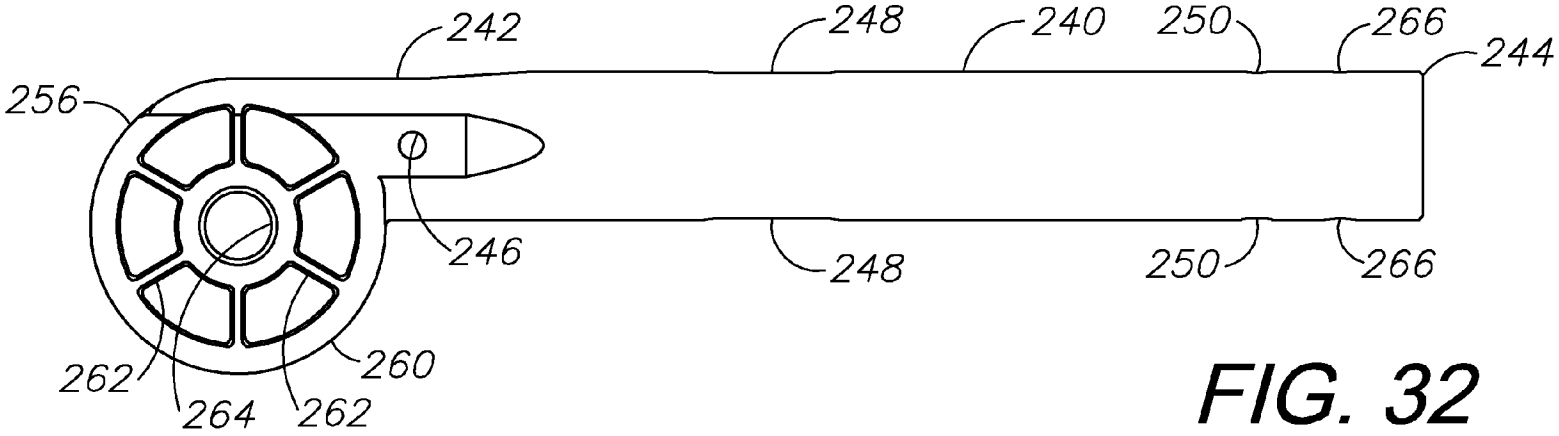
FIG. 32 is a rear elevational view of the arm.
Figure 33:
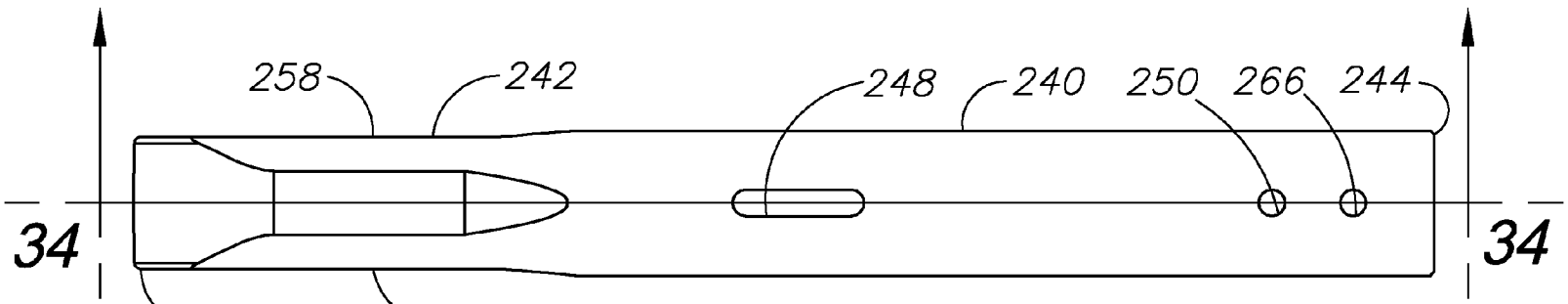
FIG. 33 is a plan view of the arm.
Figure 34:
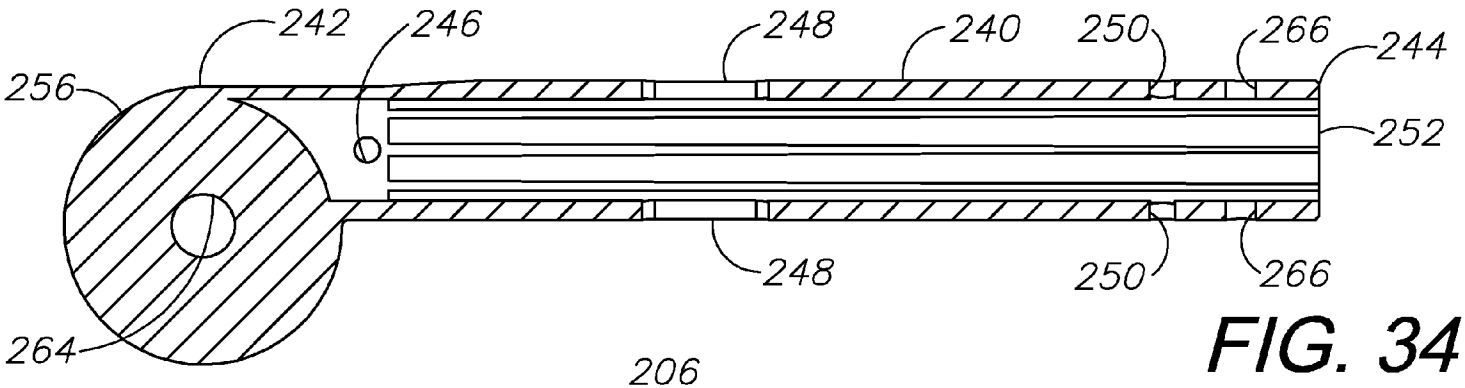
FIG. 34 is a sectional view of the arm taken along the line 34 in FIG. 33.

Referring to FIGS. 32-34, the arm 240 and hub 256 are manufactured from plastic, preferably acetal plastic. The distal end 244 of the tubular arm 240 has an adapter 290 for connecting to an object (not shown) including, but not limited to the shaft 35 of an umbrella 56 as shown in FIG. 1 above, or a flag. The adapter 290 is secured by a threaded fastener or an adapter pin 296 using the receivers 266 located on the top and bottom of the arm 240 proximate the receivers 266. A pair of opposing receivers 250 located on the top and bottom of the arm 240 nearest the distal end 244 secure a spring pin 254. A pair of opposing, elongated slots 248 located on the top and bottom of the arm 240 are for slidably receiving a cam pin 236 that passes through both the sleeve 276 and the cam 268. The slots 248 are aligned along the length of the arm 146 approximately midway between the proximal 242 and distal 244 ends of the arm 240. A pair of opposing receivers 246 located on the front and back of the arm 240 nearest the proximal end 242 are for slidably receiving the pegs 178 of the locking spring 170. The hub 256 is generally a disc, with a centrally located transverse receiver 264 for receiving the pivot bolt 168 passing through the front and back discs 228, 230, and plurality of pie-shaped recesses 262 depending from the front and rear faces 258, 260 toward the interior of the hub 246. The interior of the arm 240 contains a plurality of ribs 252 that each run the length of the arm 240 between the receivers 246 and the distal end 244, and taper from a relatively thick and narrow proximal end 242 portion to a relatively thin and wide distal end 244 portion.

Figure 35:
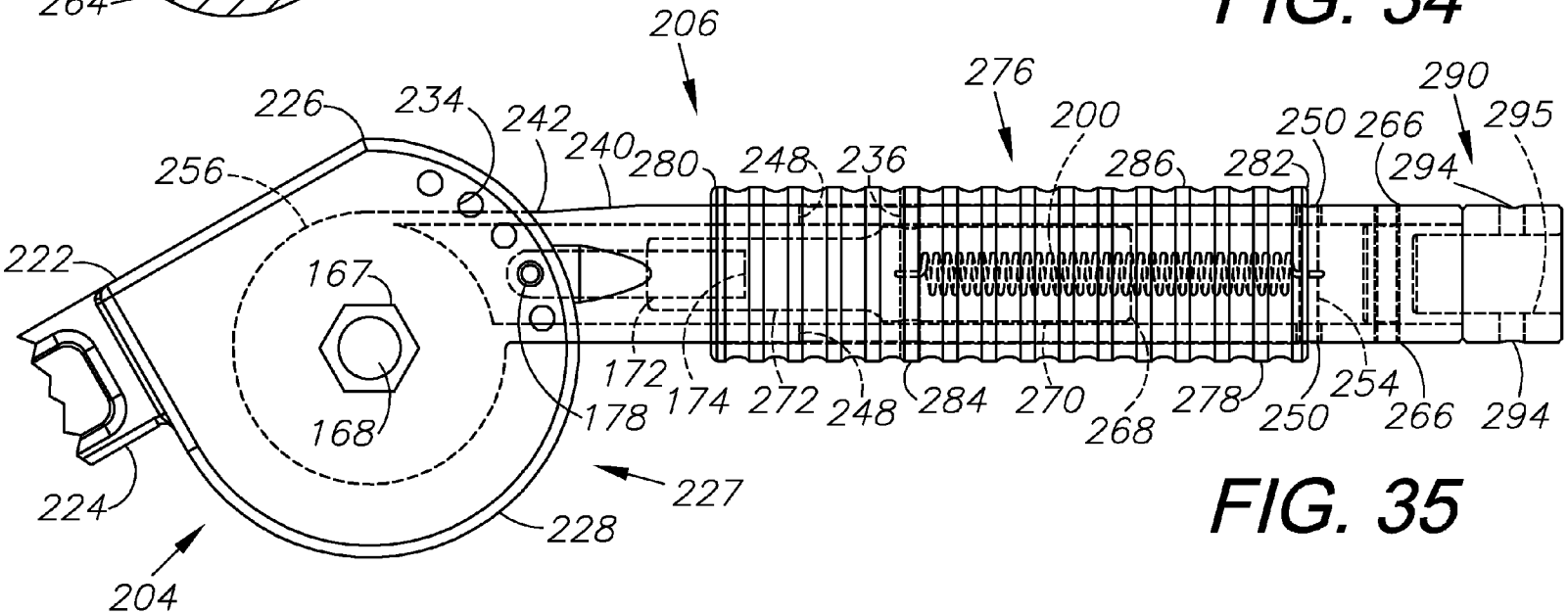
FIG. 35 is a rear elevational view of the arm assembly taken generally within the circle 35 in FIG. 28.

Referring to FIGS. 35-43, the arm assembly 206 and its various components will be shown and described. FIG. 35 is an enlarged fragmentary view of the frame 222 and arm assembly 206 showing in particular the arm 240 with an internally located locking spring 170, cam 268 and return spring 200, and an externally located sleeve 276. The pegs 178 of the locking spring 170 are shown engaging a pair of register receivers 234 in the head 226. The arm assembly 206 and mounting bracket assembly 204 are joined by a nut 167 and bolt 168 combination permitting free rotation of the arm assembly 206 about the bolt 168. The cam pin 236 is shown passing through the slots 248 in the arm 240, the receivers 284 in the sleeve 276, and the receivers 274 in the cam 268, thereby connecting the sleeve 276 and cam 26 together, and permitting them to slide together along the length of the slot 248. The return spring 200 is shown attached to both the cam pin 236 and spring pin 254. The spring pin 254 is shown secured within the receivers 250 in the arm 240.

Figure 36:
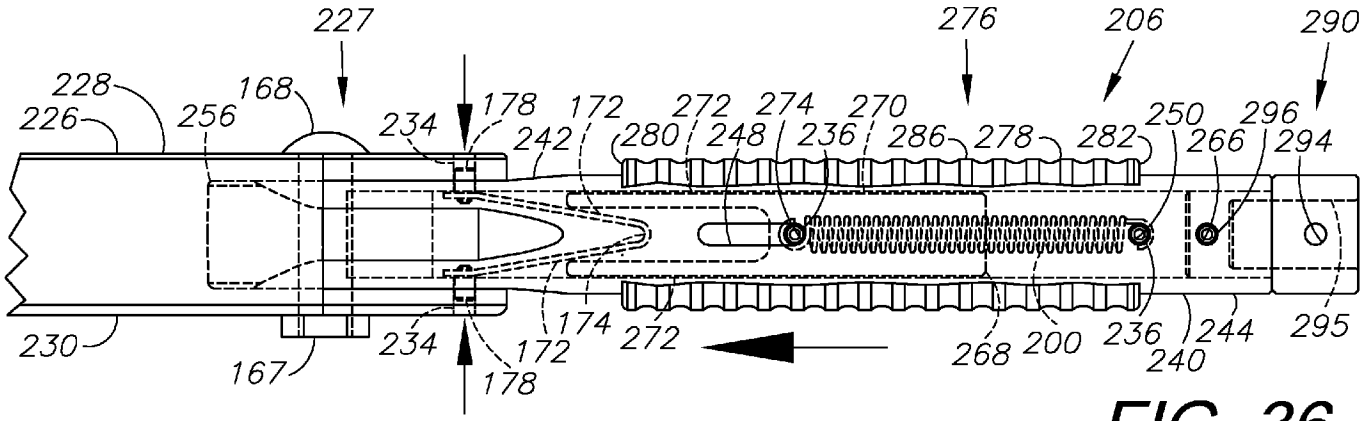
FIG. 36 is a plan view of the arm assembly showing the spring pins engaging the index receivers of the frame.
Figure 37:
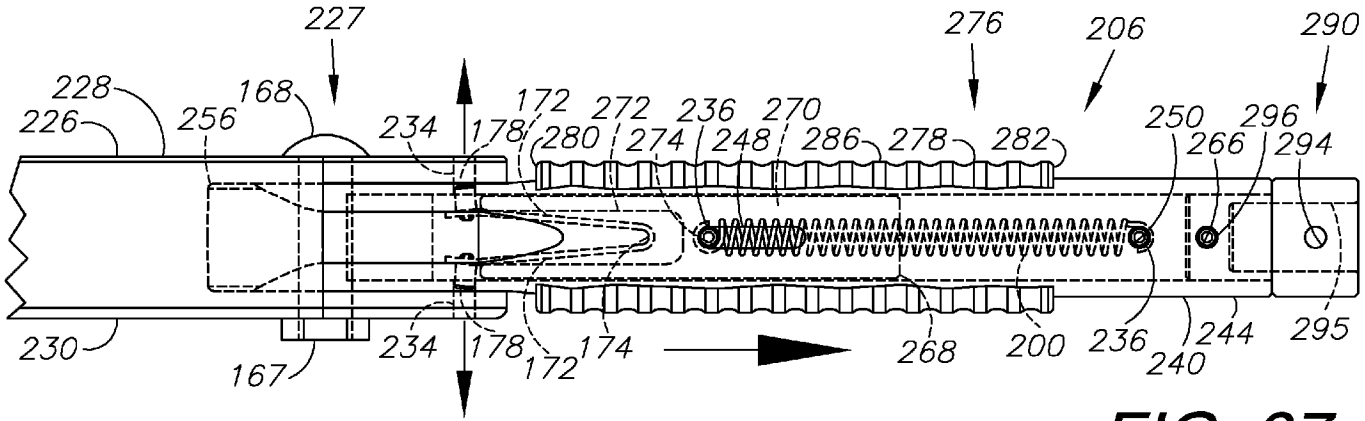
FIG. 37 is a plan view of the arm assembly showing the spring pins disengaged from the index receivers of the frame.
Figure 40:
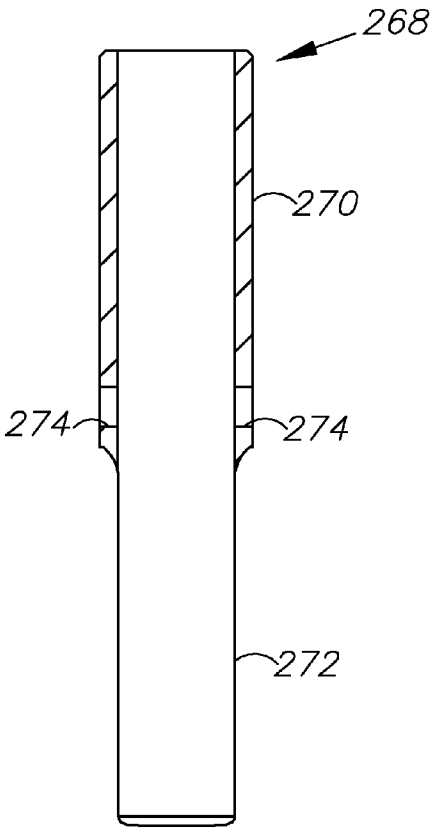
FIG. 40 is a sectional view of the cam taken along the line 40 in FIG. 38.
Figure 39:
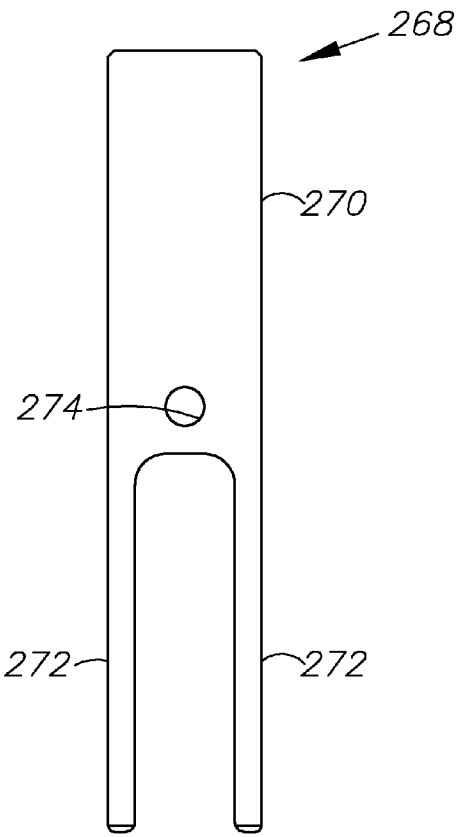
FIG. 39 is a plan view of the cam.
Figure 38:
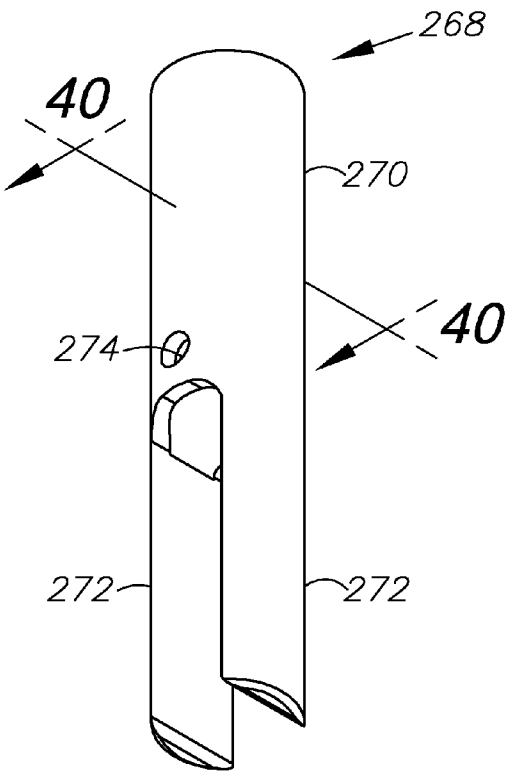
FIG. 38 is a left rear isometric view from above of the cam.
Figure 41:
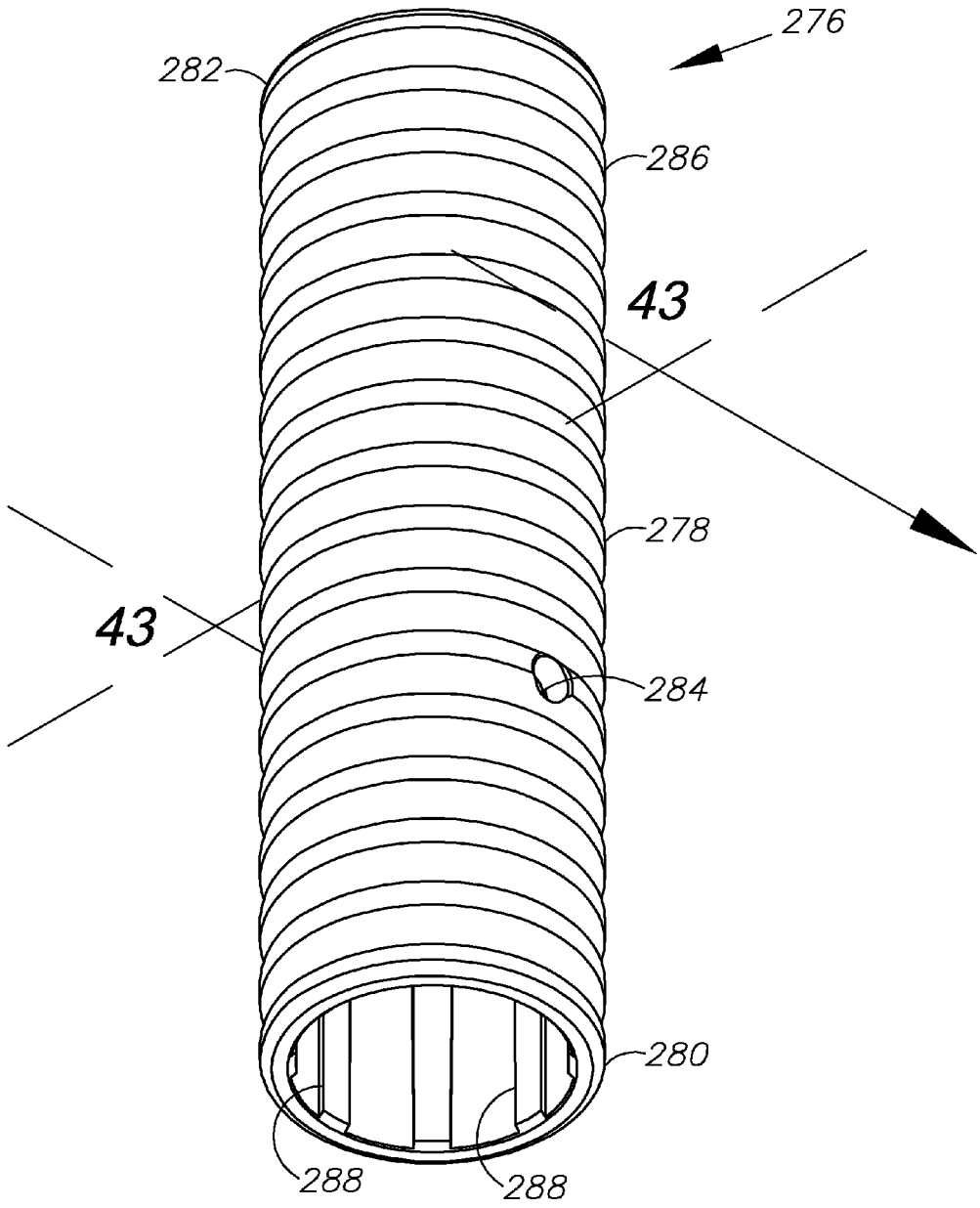
FIG. 41 is a left rear isometric view from below of the sleeve.
Figure 44:
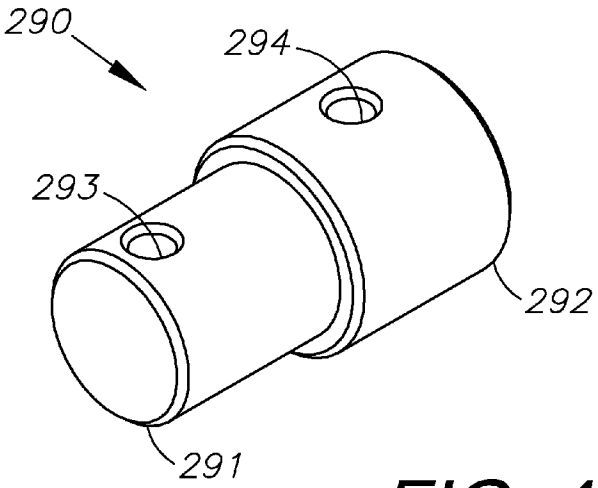
FIG. 44 is a left rear isometric view from above of the adapter.
Figure 45:
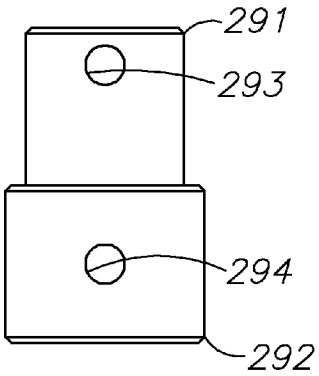
FIG. 45 is a plan view of the adapter.
Figure 46:
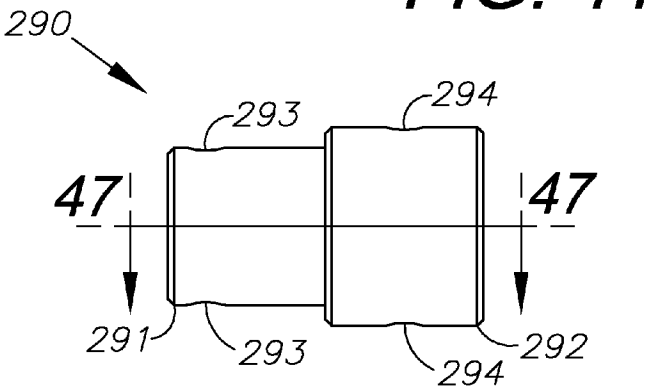
FIG. 46 is a rear elevational view of the adapter.
Figure 47:
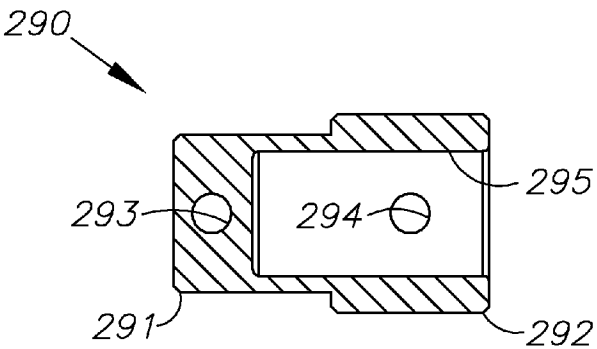
FIG. 47 is a sectional view of the adapter taken along the line 47 in FIG. 46.

FIGS. 36-38 show a top view of the arm assembly 206 and how the sleeve 276 and cam 268 cooperate to disengage the pegs 178 from the register receivers 234 enabling repositioning of the arm assembly 206. FIG. 36 shows the arm assembly 206 in a fixed position whereby the pegs 178 of the locking spring 170 are engaging the register receivers 234 of the head 226. The locking spring 170 (FIGS. 19-20) is the same as described above, and dimensioned to fit within the arm 240. The locking spring 170 is compressed brining the feet 176 together by the pinching force of the inner surface of the legs 272 on the cam 268 being slid along the outer surface of the legs 172 of the locking spring 170. The cam 268 (FIGS. 38-40) is generally a hollow tube having a body 270 with a transverse receiver 274 dimensioned to slidably receive the cam pin 236, and opposite legs 272 depending therefrom. The cam 268 is dimensioned to slidably fit within the arm 240 and is manufactured from plastic, preferably acetal plastic. The legs 272 are orientated whereby the head 174 of the locking spring 170 passes between the legs 272, and the inner surface of the legs 272 engage the outer surface of the legs 172 of the locking spring 170. The sleeve 276 (FIGS. 41-43) is a hollow tube with an elongated body 278 dimensioned to slide along the exterior of the arm 240 with an opening at both the proximal 280 and distal 282 ends. The sleeve 276 is manufactured from plastic, preferably acetal plastic. Transverse opposing receivers 284 passing through the body 278 near the proximal end 280 are dimensioned to securely receive the cam pin 236. A plurality of ridges 286 circumscribe the exterior of the sleeve 276 providing the user with a gripping surface. The interior of the sleeve 276 contains a plurality of collinear ribs 288 each of which taper from a relatively thick and narrow proximal and distal end 280, 282 portions to a relatively thin and wide medial 283 portion. The return spring 200 is dimensioned to slidably fit within the cam 268, and attaches to the cam pin 236 and spring pin 254. As above, the return spring 200 is under tension when the cam 268 and sleeve 276 are in their most distal and proximal positions, and the spring has sufficient force to return the sleeve 276 and cam 268 to their most distal position after being drawn to the proximal end 242 of the arm 240 and released.

The adapter 290 (FIGS. 27-28, 35-37, and 44-47) is as described above. The proximal end 291 is dimensioned to slidably fit within the arm 240. The adapter 290 is mounted to the arm assembly 206 by aligning the arm receivers 293 with the receivers 266 on the distal end of the arm 240 and secured therethrough using a fastener including, but not limited to a threaded fastener or an adapter pin 296. A cavity 295 extends from the distal end 292 into the proximal end 291 of the adapter 290 for receiving a support (not shown) such as the shaft 35 in FIG. 1 for an object (not shown). The support is secured to the adapter 290 by inserting a fastener through the object receiver 294 and into the support.

The adjustment of the arm assembly 206 is accomplished by mechanical operation of the sleeve 276 much like the operation of the arm assembly 110 above. The mechanical force of the locking spring 170 returning to an uncompressed state keeps the pegs 178 engaged with the register receivers 234. When the pegs 178 are engaged, the legs 272 of the cam 268 do not pinch the legs 172 of the locking spring 170 sufficiently to cause the pegs 178 to disengage the register receivers 234. Moving the sleeve 276 toward the proximal end 242 of the arm 240 causes the cam 268 to move an equal distance toward the proximal end 242 of the arm 240 whereby the legs 272 of the cam 268 slide along the legs 172 of the locking spring 170 biasing the feet 176 inward, toward each other and drawing the pegs 178 out of engagement with the register receivers 234. Once the pegs 178 are disengaged, the arm assembly 206 may be rotated to engage a different set of register receivers 234, or may be rotated down into a collapsed position whereby the arm assembly 206 and the body 224 of the frame 222 are adjacent and substantially parallel. Rotating the arm assembly 206 into a collapsed position enables the connector 202 or any object connected to it, to remain attached to the chair 52 when the chair 52 is collapsed for storage. When the sleeve 276 is not being held in proximity to the proximal end 242 of the arm 240, the desire of the locking spring 170 to return to an uncompressed state forces the pegs 178 to engage the register receivers 234.

It is to be understood that while certain aspects of the invention have been shown and described, the invention is not limited thereto and encompasses various other embodiments and aspects. Other embodiments and applications of the disclosed invention will be apparent to those skilled in the art from a consideration of the specification or practice of the invention disclosed herein. Although the disclosed invention has been employed in use with a collapsible chair, the above mentioned application is intended to be exemplary and is not intended to be exemplary and is no means meant to limit the scope of the invention.

Having thus described the disclosed subject matter, what is claimed as new and desired to be secured by Letters Patent is:

1. An adjustable connector assembly comprising:

a first elongated member and a second elongated member;

an elongated mounting member having a first end and a second end, said mounting member being adapted for attachment to said first elongated member;

an elongated frame having a first end and a second end, said first end having a hinge joint;

a bracket connecting said mounting member and said frame;

an elongated arm assembly having a proximal end and a distal end, said proximal end pivotally connected to said hinge joint, said second elongated member being adapted for attachment to said elongated arm assembly; and said elongated arm assembly including:

(1) a tubular arm having slots;

(2) a tubular sleeve having opposing transverse receivers;

(3) a tubular cam having a proximal end and a distal end, said distal end having a pair of legs extending therefrom, a transverse receiver extending through the top and bottom of said cam, said cam disposed within said tubular arm;

(4) a cam pin slidably received within said slots in said arm and said receiver in said cam, said cam pin secured within said receivers in said sleeve;

(5) an elongated helical return spring having a proximal end and a distal end, said return spring slidably received within said cam, said return spring proximal end connected to said cam pin, and said return spring distal end connected to a spring pin; and (6) a locking member at said elongated arm proximal end from said hinge joint to permit said pivotal movement.

2. The adjustable connector assembly of claim 1, wherein said hinge joint includes:

a clevis-shaped head, said head having a front disc and an opposing back disc, each of said discs having a centrally located transverse pivot receiver and a plurality of peripherally located register receivers;

a disc-shaped hub, said hub having a transverse pivot receiver, said hub disposed between said head front and back discs, said hub connected to said arm assembly proximal end; and a nut and bolt combination, said bolt slidably received within said hub pivot receiver and said discs pivot receivers, said nut securing said bolt to said head.

3. The adjustable connector assembly of claim 2, wherein said arm assembly includes:

said tubular arm having: (1) a proximal end and a distal end, said arm proximal end located at said hub; (2) a pair of opposing, transverse, distal receivers located on the top and bottom of said arm in proximity to said arm distal end; (3) a pair of opposing, transverse, proximal receivers located on the front and back of said arm in proximity to said arm proximal end, said proximal receivers selectively aligning with said register receivers; (4) said pair of slots being opposing, transverse, elongated and aligned along the length of said arm generally midway between said distal receivers and said proximal receivers; and (5) a pair of opposing, transverse, spring receivers located on the top and bottom of said arm between said distal receivers and said elongated slots;

said tubular sleeve having a proximal end and a distal end, said pair of opposing transverse receivers located on the top and bottom of said sleeve; said sleeve slidably received on said arm;

said locking member being a V-shaped locking spring having a first spring leg and a second spring leg extending from a distal end and terminating at a proximal end, each of said spring legs having a peg extending laterally therefrom, said pegs disposed within said arm proximal receivers, said locking spring disposed within said arm;

said spring pin secured within said spring receivers in said arm;

and said pegs slidably engaging said register receivers.

4. The adjustable connector assembly of claim 3, wherein:

said mounting member is tubular and has a cap at said first end and is open at said second end, said mounting member having a slot partially circumscribing the perimeter of said mounting member;

said first elongated member received within said mounting member; and said bracket extending from said mounting member second end and attaching to said frame second end.

5. The adjustable connector assembly of claim 4, further including:

a cylindrical adapter having a proximal end and a distal end, said proximal end dimensioned to engage said arm distal end;

a transverse arm receiver passing through the top and bottom of said adapter proximal end;

a transverse object receiver passing through said adapter distal end;

said adapter distal end having a cavity adapted for receiving said second elongated member; and an adapter pin, said adapter secured to said arm distal end by securing said adapter pin within said receiver and said distal arm receiver.

6. The adjustable connector assembly of claim 3, wherein:

said mounting member is a rod, said mounting member received within said first elongated member; and said bracket extending from said mounting member first end and attaching to said frame second end.

7. The adjustable connector assembly of claim 1, wherein said arm assembly includes:

aid tubular arm having: (1) a proximal end and a distal end, said arm proximal end located at said hub; (2) a pair of opposing, transverse, distal receivers located on the top and bottom of said arm in proximity to said arm distal end; (3) a pair of opposing, transverse, proximal receivers located on the front and back of said arm in proximity to said arm proximal end, said proximal receivers selectively aligning with said register receivers; (4) said pair of slots being opposing, transverse, elongated and aligned along the length of said arm generally midway between said distal receivers and said proximal receivers; and (5) a pair of opposing, transverse, spring receivers located on the top and bottom of said arm between said distal receivers and said elongated slots;

said tubular sleeve having a proximal end and a distal end, said pair of opposing transverse receivers located on the top and bottom of said sleeve; said sleeve slidably received on said arm;

said locking member being a V-shaped locking spring having a first spring leg and a second spring leg extending from a distal end and terminating at a proximal end, each of said spring legs having a peg extending laterally therefrom, said pegs disposed within said arm proximal receivers, said locking spring disposed within said arm;

said spring pin secured within said spring receivers in said arm;

and said pegs slidably engaging said frame first end.

8. The adjustable connector assembly of claim 7, further including:

a cylindrical adapter having a proximal end and a distal end, said proximal end dimensioned to engage said arm distal end;

a transverse arm receiver passing through the top and bottom of said adapter proximal end;

a transverse object receiver passing through said adapter distal end;

said adapter distal end having a cavity adapted for receiving said second elongated member; and an adapter pin, said adapter secured to said arm distal end by securing said adapter pin within said receiver and said distal arm receiver.

9. The adjustable connector assembly of claim 8, wherein:

said mounting member is tubular and has a cap at said first end and is open at said second end, said mounting member having a slot partially circumscribing the perimeter of said mounting member;

said first elongated member received within said mounting member; and said bracket extending from said mounting member second end and attaching to said frame second end.

10. The adjustable connector assembly of claim 1, wherein:

said mounting member is tubular and has a cap at said first end and is open at said second end, said mounting member having a slot partially circumscribing the perimeter of said mounting member;

said first elongated member received within said mounting member; and said bracket extending from said mounting member second end and attaching to said frame second end.

11. The adjustable connector assembly of claim 10, further including:

a cylindrical adapter having a proximal end and a distal end, said proximal end dimensioned to engage said arm assembly distal end;

a transverse arm receiver passing through the top and bottom of said adapter proximal end;

a transverse object receiver passing through said adapter distal end;

said adapter distal end having a cavity adapted for receiving said second elongated member; and an adapter pin, said adapter secured to said arm assembly distal end by securing said adapter pin within said receiver and said distal arm receiver.

12. The adjustable connector assembly of claim 11, wherein:

said mounting member, frame, and bracket are integrally molded from plastic.

13. An adjustable connector for first and second elongated members, which connector comprises:

a frame having a first end and a second end, said first end having a hinge joint, and said second end being adapted for attachment to said first elongated member;

an elongated arm assembly having a proximal end and a distal end, said proximal end pivotally connected to said hinge joint, and said second elongated member being adapted for attachment to said arm assembly distal end;

said arm assembly comprising:

(a) a tubular arm having: (1) a proximal end and a distal end, said arm proximal end connected to said hinge joint; (2) a pair of opposing, transverse, distal receivers located on the top and bottom of said arm in proximity to said arm distal end; (3) a pair of opposing, transverse, proximal receivers located on the front and back of said arm in proximity to said arm proximal end, said proximal receivers selectively aligning with said frame first end; (4) a pair of opposing, transverse, elongated slots aligned along the length of said arm generally midway between said distal receivers and said proximal receivers; and (5) a pair of opposing, transverse, spring receivers located on the top and bottom of said arm between said distal receivers and said elongated slots;

(b) a tubular sleeve having a proximal end and a distal end, a pair of opposing transverse receivers located on the top and bottom of said sleeve; said sleeve slidably received on said arm;

(c) a tubular cam having a proximal end and a distal end, said distal end having a pair of legs extending therefrom, a transverse receiver extending through the top and bottom of said cam, said cam disposed within said arm;

(d) a V-shaped locking spring having a first leg and a second leg extending from a distal end and terminating at a proximal end, each of said spring legs having a peg extending laterally therefrom, said pegs disposed within said arm proximal receivers, said locking spring disposed within said arm;

(e) a cam pin slidably received within said slots in said arm and said receiver in said cam, said cam pin secured within said receivers in said sleeve;

(f) a spring pin secured within said spring receivers in said arm;

(g) an elongated helical return spring having a proximal end and a distal end, said return spring slidably received within said cam, said return spring proximal end connected to said cam pin, and said return spring distal end connected to said spring pin; and said pegs slidably engaging said frame first end.

14. The adjustable connector of claim 13, further comprising:

an elongated mounting member having a first end and a second end;

said frame having an elongated body between said frame first end and said frame second end; and said frame second end connected to said mounting member second end by a bracket.

15. The adjustable connector of claim 14, further comprising:

said frame head is clevis-shaped, said head having a front disc and an opposing back disc, each of said discs having a centrally located transverse pivot receiver and a plurality of peripherally located register receivers;

a disc-shaped hub, said hub having a transverse pivot receiver, said hub disposed between said head front and back discs, said hub connected to said arm assembly proximal end; and a nut and bolt combination, said bolt slidably received within said hub pivot receiver and said discs pivot receivers, said nut securing said bolt to said head.

16. The adjustable connector of claim 15, further comprising:

a cylindrical adapter having a proximal end and a distal end, said proximal end dimensioned to engage said arm distal end;

a transverse arm receiver passing through the top and bottom of said adapter proximal end;

a transverse object receiver passing through said adapter distal end;

said adapter distal end having a cavity adapted for receiving said second elongated member; and an adapter pin, said adapter secured to said arm distal end by securing said adapter pin within said receiver and said distal arm receiver.

17. The adjustable connector of claim 16, wherein:

said mounting member is tubular and has a cap at said first end and is open at said second end, said mounting member having a slot partially circumscribing the perimeter of said mounting member;

said first elongated member received within said mounting member; and said bracket extending from said mounting member second end and attaching to said frame second end.

18. The adjustable connector of claim 16, wherein:

said mounting member is a rod, said mounting member received within said first elongated member; and said bracket extending from said mounting member first end and attaching to said frame second end.

19. The adjustable connector of claim 13, further including:

a cylindrical adapter having a proximal end and a distal end, said proximal end dimensioned to engage said arm distal end;

a transverse arm receiver passing through the top and bottom of said adapter proximal end;

a transverse object receiver passing through said adapter distal end;

said adapter distal end having a cavity adapted for receiving an elongated object; and an adapter pin, said adapter secured to said arm distal end by securing said adapter pin within said receiver and said distal arm receiver.

20. An adjustable connector for first and second elongated members, which connector comprises:

a tubular mounting member having a first end and a second end, a slot partially circumscribing the perimeter of said mounting member, said mounting member being adapted for attachment to said first elongated member;

an elongated frame having a first end and a second end, said first end having a clevis-shaped head;

a bracket connecting said mounting member second end and said elongated frame second end;

said head having a front disc and an opposing back disc, each of said discs having a centrally located transverse pivot receiver and a plurality of peripherally located register receivers;

an elongated arm assembly including:

(1) a tubular arm having: (a) a proximal end and a distal end; (b) a disc-shaped hub, said hub having a transverse pivot receiver, said hub disposed between said head front and back discs, said hub connected to said arm proximal end; (c) a pair of opposing, transverse, distal receivers located on the top and bottom of said arm in proximity to said arm distal end; (d) a pair of opposing, transverse, proximal receivers located on the front and back of said arm in proximity to said arm proximal end, said proximal receivers selectively aligning with said register receivers; (e) a pair of opposing, transverse, elongated slots aligned along the length of said arm generally midway between said distal receivers and said proximal receivers; and (f) a pair of opposing, transverse, spring receivers located on the top and bottom of said arm between said distal receivers and said elongated slots;

(2) a tubular sleeve having a proximal end and a distal end, a pair of opposing transverse receivers located on the top and bottom of said sleeve; said sleeve slidably received on said arm;

(3) a tubular cam having a proximal end and a distal end, said distal end having a pair of legs extending therefrom, a transverse receiver extending through the top and bottom of said cam, said cam disposed within said arm;

(4) a V-shaped locking spring having a first leg and a second leg extending from a distal end and terminating at a proximal end, each of said spring legs having a peg extending laterally therefrom, said pegs disposed within said arm proximal receivers, said locking spring disposed within said arm;

(5) a cam pin slidably received within said slots in said arm and said receiver in said cam, said cam pin secured within said receivers in said sleeve;

(6) a spring pin secured within said spring receivers in said arm; and (7) an elongated helical return spring having a proximal end and a distal end, said return spring slidably received within said cam, said return spring proximal end connected to said cam pin, and said return spring distal end connected to said spring pin;

said pegs slidably engaging said register receivers;

a cylindrical adapter having a proximal end and a distal end, said proximal end dimensioned to engage said arm distal end;

a transverse arm receiver passing through the top and bottom of said adapter proximal end;

a transverse object receiver passing through said adapter distal end;

said adapter distal end having a cavity adapted for receiving said second elongated member; and an adapter pin, said adapter secured to said arm distal end by securing said adapter pin within said receiver and said distal arm receiver.

* * * * *